US007515869B2

(12) United States Patent
Ferlitsch

(10) Patent No.: US 7,515,869 B2
(45) Date of Patent: Apr. 7, 2009

(54) SYSTEMS AND METHODS FOR ADDING POST-COLLATION OPERATIONS AND INTERLEAVED IMAGING JOBS TO AN IMAGING JOB

(75) Inventor: Andrew R. Ferlitsch, Tigard, OR (US)

(73) Assignee: Sharp Laboratories of America, Inc., Camas, WA (US)

( * ) Notice: Subject to any disclaimer, the term of this patent is extended or adjusted under 35 U.S.C. 154(b) by 774 days.

(21) Appl. No.: 11/199,475

(22) Filed: Aug. 8, 2005

(65) Prior Publication Data

US 2005/0270573 A1 Dec. 8, 2005

Related U.S. Application Data

(62) Division of application No. 10/744,653, filed on Dec. 23, 2003, now Pat. No. 6,968,150.

(51) Int. Cl.
*G03G 15/00* (2006.01)

(52) U.S. Cl. ..... 399/403; 399/397; 399/407; 358/1.15; 400/61

(58) Field of Classification Search ..... 399/397, 399/403, 407; 358/1.15; 400/61
See application file for complete search history.

(56) References Cited

U.S. PATENT DOCUMENTS 5,697,040 A 12/1997 Rabjohns et al.
5,715,381 A 2/1998 Hamilton
5,887,991 A 3/1999 Narita et al.
6,151,131 A 11/2000 Pepin et al.
6,219,151 B1 4/2001 Manglapus et al.
6,418,279 B1 7/2002 Weinberger et al.
6,494,453 B1 12/2002 Yamada et al.
6,621,589 B1 9/2003 Al-Kazily et al.
6,860,657 B2 3/2005 Katamoto et al.
6,863,455 B2 3/2005 Blom et al.
2002/0018235 A1 2/2002 Ryan et al.
2002/0027673 A1 * 3/2002 Roosen et al. ..... 358/1.13
2002/0042798 A1 4/2002 Takei et al.
2002/0051174 A1 * 5/2002 Betts et al. ..... 358/1.15
2004/0190014 A1 9/2004 Ferlitsch

FOREIGN PATENT DOCUMENTS

JP 63-083825 4/1988
JP 2001-312377 11/2001

* cited by examiner

*Primary Examiner*—Ren Yan
*Assistant Examiner*—Andy L Pham
(74) *Attorney, Agent, or Firm*—Austin Rapp & Hardman

(57) ABSTRACT

A system for adding a post-collation operation to an imaging job is disclosed. The system includes a computing device with executable instructions. The executable instructions are executable on the computing device and are configured to implement a method for adding a post-collation operation to the imaging job. The imaging job is received downstream from an origination point of the imaging job and upstream from a job interpreter/rasterization process in an imaging device. New commands are inserted into the imaging job that relate to a post-collation operation. Another use of the method for multi-job interleaving is also disclosed.

3 Claims, 16 Drawing Sheets

902
Continuous Imaging Job w/o Finishing
Imaging Job Generation
Start RIP 904
Job Header 906
Page 1 908a
Page 2 908b
....
End RIP 910

1002
Continuous Imaging Job with Finishing
Imaging Job Generation 1001
Start RIP 1004
Job Header 1006
Page 1 1008a
Page 2 1008b
....
End RIP 1010
Finishing 1016
Save Context 1012
End RIP 1014
Start RIP 1018
Restore Context 1020
Finishing 1022
Finishing Input 1024

SYSTEMS AND METHODS FOR ADDING POST-COLLATION OPERATIONS AND INTERLEAVED IMAGING JOBS TO AN IMAGING JOB

CROSS-REFERENCE TO RELATED APPLICATION

This application is a divisional of U.S. patent application Ser. No. 10/744,653, filed Dec. 23, 2003, and now issued as U.S. Pat. No. 6,968,150.

TECHNICAL FIELD

The present invention relates generally to imaging jobs sent to imaging devices through use of a computer. More specifically, the present invention relates to systems and methods for adding post-collation operations and interleaved imaging jobs to an imaging job.

BACKGROUND

Computer and communication technologies continue to advance at a rapid pace. Indeed, computer and communication technologies are involved in many aspects of a person's day. For example, many devices being used today by consumers have a small computer incorporated within the device. These small computers come in varying sizes and degrees of sophistication. These small computers may vary in sophistication from one microcontroller to a fully-functional complete computer system. For example, small computers may be a one-chip computer, such as a microcontroller, a one-board type of computer, such as a controller, or a typical desktop computer, such as an IBM-PC compatible, etc.

Printers are used with computers to print various kinds of items including letters, documents, pictures, etc. Many different kinds of printers are commercially available. Ink jet printers and laser printers are fairly common among computer users. Ink jet printers propel droplets of ink directly onto the paper. Laser printers use a laser beam to print.

Printers are a type of imaging device. Imaging devices include, but are not limited to, physical printers, multi-functional peripherals, a printer pool, a printer cluster, a fax machine, a plotter, a scanner, a logical device, an electronic whiteboard, a tablet PC, a computer monitor, a file, etc.

Different kinds of computer software facilitate the use of imaging devices. The computer or computing device that will be used to print the materials typically has one or more pieces of software running on the computer that enable it to send the necessary information to the printer to enable printing of the materials. If the computer or computing device is on a computer network there may be one or more pieces of software running on one or more computers on the computer network that facilitate printing.

In certain computing environments, it is desirable to be able to add to or modify the imaging job after it has been generated. Being able to add to or modify the imaging job may be useful for a variety of reasons including, but not limited to, having the ability to add finishing options to an imaging job or having the ability to interleave imaging jobs. Benefits may be realized by providing increased functionality to the hardware and/or software used in processing imaging jobs.

BRIEF DESCRIPTION OF THE DRAWINGS

The present embodiments will become more fully apparent from the following description and appended claims, taken in conjunction with the accompanying drawings. Understanding that these drawings depict only typical embodiments and are, therefore, not to be considered limiting of the invention's scope, the embodiments will be described with additional specificity and detail through use of the accompanying drawings in which:

DETAILED DESCRIPTION

Figure 1:
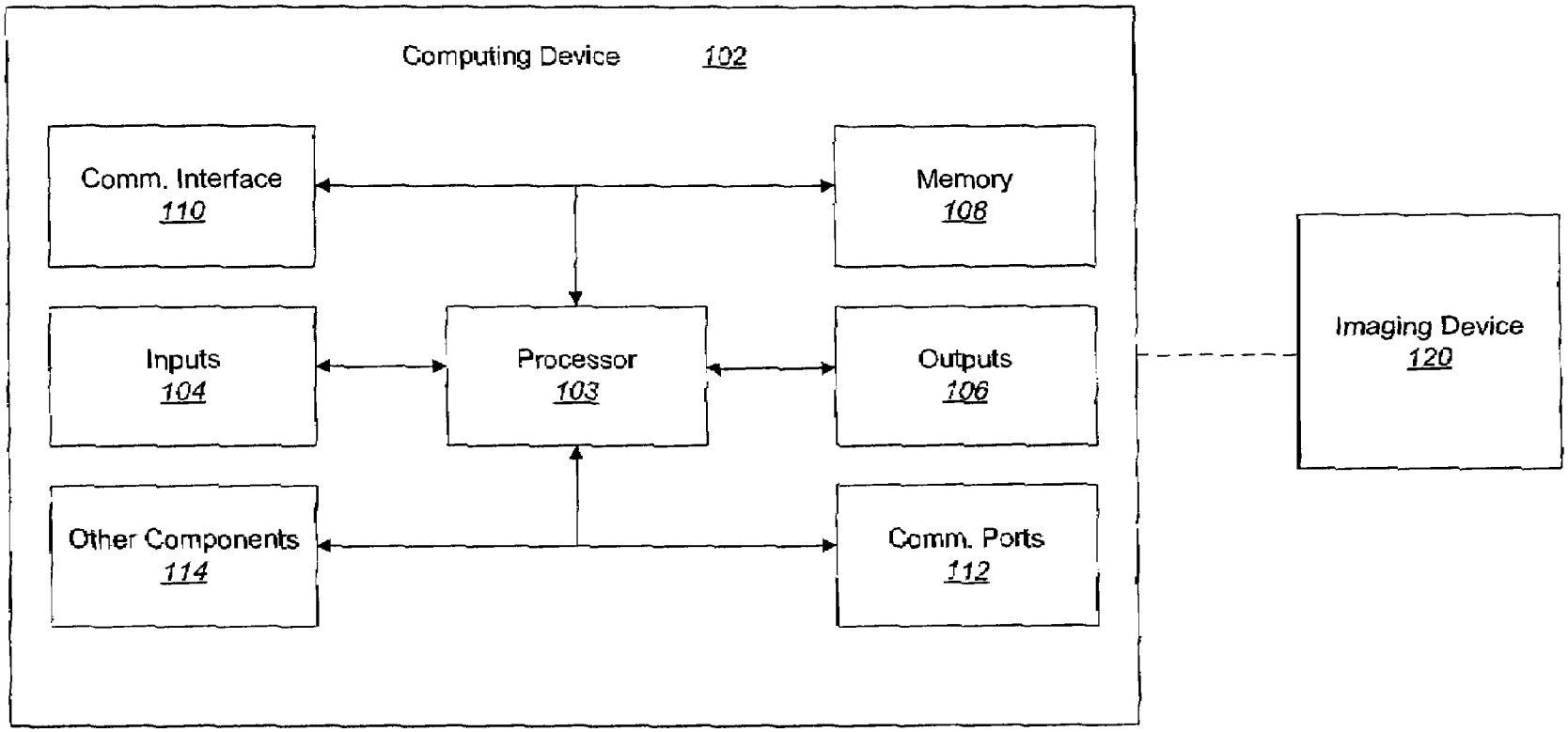
FIG. 1 is a block diagram illustrating the major hardware components typically utilized with embodiments herein.

A system for adding a post-collation operation to an imaging job is disclosed. The system includes a computing device with executable instructions. The executable instructions are executable on the computing device and are configured to implement a method for adding a post-collation operation to the imaging job. The imaging job is received downstream from an origination point of the imaging job and upstream from a job interpreter/rasterization process in an imaging device. New commands are inserted into the imaging job that relate to a post-collation operation. Another use of the method for multi-job interleaving is also disclosed.

A method for adding a post-collation operation to an imaging job sent to an imaging device downstream from the origin of the imaging job is also disclosed. An imaging job is created and sent to an imaging device. The imaging job is received downstream from an origination point of the imaging job and upstream from a job interpreter/rasterization process in an imaging device. New commands are inserted into the imaging job that relate to a post-collation operation. The imaging job is started at the imaging device. The post-collation operation is performed at the imaging device.

In one embodiment disclosed the imaging job is a continuous imaging job. The new commands inserted into the imaging job may include interleaving finishing options within subsets of pages in the continuous imaging job. The new commands may also be intra-document post-collation operations.

Inserting new commands into the imaging job may include inserting a save context command into the imaging job, inserting a terminate RIP command into the imaging job, inserting a new RIP command into the imaging job, and inserting a restore context command into the imaging job.

An imaging device that includes an interpreter is also disclosed. The interpreter performs a method that includes identifying context information in an imaging job, saving the context information of the imaging job, and restoring the context information across a RIP boundary. Saving the context information may be performed on a page boundary.

In one embodiment the context information may include job context information and page context information. The page context information may include persistent data and non-persistent data.

A set of executable instructions for implementing a method for adding a post-collation operation to an imaging job is also disclosed. The imaging job is received downstream from an origination point of the imaging job. A save context command is inserted into the imaging job. A terminate RIP command is also inserted into the imaging job. A new command is inserted into the imaging job that relates to a post-collation finishing operation. A new RIP command is inserted into the imaging job. A restore context command is inserted into the imaging job.

The set of executable instructions may be stored on a computer-readable medium. Furthermore, the computer-readable medium may be part of an imaging device. The imaging device may include, but is not limited to, a printer, a scanner, a fax machine, a copier and a document server.

A method for adding a post-collation operation to an imaging job sent to an imaging device downstream from the origin of the imaging job is also disclosed. The imaging job is received downstream from an origination point of the imaging job and upstream from a job interpreter/rasterization process in an imaging device. It then determines, at a page end boundary, if the page ends a sequence of pages where a finishing option will be applied, and if the page does end a sequence of pages where a finishing option will be applied, the method then saves current context information and ends the current RIP. It also determines, at a page begin boundary, if the page starts a sequence of pages where a finishing option will be applied, and if the page does start a sequence of pages where a finishing option will be applied, the method starts a new RIP, restores saved context information and updates the job context with finishing options. In one embodiment the method may include parsing the imaging job to identify page boundaries.

A computer-readable medium for storing program data is also disclosed. The program data includes executable instructions for implementing a method in a computing device for adding a post-collation operation to an imaging job. In the method the imaging job is received downstream from an origination point of the imaging job and upstream from a job interpreter/rasterization process in an imaging device. It then determines, at a page end boundary, if the page ends a sequence of pages where a finishing option will be applied, and if the page does end a sequence of pages where a finishing option will be applied, the method then saves current context information and ends the current RIP. It also determines, at a page begin boundary, if the page starts a sequence of pages where a finishing option will be applied, and if the page does start a sequence of pages where a finishing option will be applied, the method starts a new RIP, restores saved context information and updates the job context with finishing options. In one embodiment the method may include parsing the imaging job to identify page boundaries.

A method for interleaving imaging jobs downstream from the origin of the imaging jobs is also disclosed. A page boundary that separates a physical sheet in a first imaging job is located. The context of the current RIP for the first imaging job is saved. The current RIP is terminated. A new RIP is started for a second imaging job. The second imaging job is inserted. The second imaging job output tray is modified to output to an alternate tray. The RIP of the second imaging job is ended. A RIP for a remainder of the first imaging job is started. The context of the first imaging job is restored. The remainder of the first imaging job is continued.

In one embodiment the method may determine whether the second imaging job is to be interleaved within the first imaging job according to criteria. The criteria may include, but are not limited to, priority and size.

Another method for interleaving imaging jobs downstream from the origin of the imaging jobs is also disclosed. A first imaging job is received downstream from a first origination point of the first imaging job and upstream from a job interpreter/rasterization process of an imaging device. A second imaging job is received downstream from a second origination point of the second imaging job and upstream from the job interpreter/rasterization process. The context of the current RIP for the first imaging job is saved. The current RIP is terminated. A new RIP is started for a second imaging job. The second imaging job is inserted. The RIP of the second imaging job is ended. A RIP for a remainder of the first imaging job is started. The context of the first imaging job is restored. The remainder of the first imaging job is continued.

A method for partitioning an imaging job sent to an imaging device downstream from the origin of the imaging job is also disclosed. The imaging job is sent to an imaging device. The imaging job is received downstream from an origination point of the imaging job and upstream from a job interpreter/rasterization process of the imaging device. A boundary in the imaging job is identified.

In one embodiment the method may include generating a print preview for the imaging job and receiving user input through a user interface presented to a user to identify a document boundary. The user input may be used to identify the boundary. The boundary may be stored. The boundary may be used to split the imaging job. In addition, the boundary may be used to split the imaging job to add a post-collation operation. Also, the boundary may be used to split the imaging job to interleave another imaging job.

In another embodiment the method may include generating a print preview for the imaging job and receiving user input through a user interface presented to a user to identify a document boundary. The user input may be used to identify the boundary. A learning process may be trained using the user input to automatically identify boundaries. Document boundary unique identifiers may be saved by the learning process. The training process may be discontinued and the boundaries in imaging jobs may be identified automatically through use of the document boundary unique identifiers.

A system that is configured to implement a method for identifying boundaries in imaging jobs is also disclosed. The system includes a computing device and executable instructions configured to implement a method for identifying boundaries in imaging jobs. The imaging job is received downstream from an origination point of the imaging job and upstream from a job interpreter/rasterization process of the imaging device. A print preview for the imaging job is generated and used to receive user input through a user interface presented to a user to identify a document boundary. The user input is used to identify the boundary. The boundary is stored. The system may include a learning process that is trained using the user input to automatically identify boundaries.

It will be readily understood that the components of the embodiments as generally described and illustrated in the Figures herein could be arranged and designed in a wide variety of different configurations. Thus, the following more detailed description of the embodiments of the systems and methods of the present invention, as represented in the Figures, is not intended to limit the scope of the invention, as claimed, but is merely representative of the embodiments of the invention.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

Several aspects of the embodiments described herein will be illustrated as software modules or components stored in a computing device. As used herein, a software module or component may include any type of computer instruction or computer executable code located within a memory device and/or transmitted as electronic signals over a system bus or network. A software module may, for instance, comprise one or more physical or logical blocks of computer instructions, which may be organized as a routine, program, object, component, data structure, etc., that performs one or more tasks or implements particular abstract data types.

In certain embodiments, a particular software module may comprise disparate instructions stored in different locations of a memory device, which together implement the described functionality of the module. Indeed, a module may comprise a single instruction, or many instructions, and may be distributed over several different code segments, among different programs, and across several memory devices. Some embodiments may be practiced in a distributed computing environment where tasks are performed by a remote processing device linked through a communications network. In a distributed computing environment, software modules may be located in local and/or remote memory storage devices.

Note that the exemplary embodiment is provided as an exemplar throughout this discussion, however, alternate embodiments may incorporate various aspects without departing from the scope of the present invention.

The order of the steps or actions of the methods described in connection with the embodiments disclosed herein may be changed by those skilled in the art without departing from the scope of the present invention. Thus, any order in the Figures or detailed description is for illustrative purposes only and is not meant to imply a required order.

FIG. 1 is a block diagram illustrating the major hardware components typically utilized with embodiments herein. The systems and methods disclosed may be used with a computing device 102 and an imaging device 120. Computing devices 102 are known in the art and are commercially available. The major hardware components typically utilized in a computing device 102 are illustrated in FIG. 1. A computing device 102 typically includes a processor 103 in electronic communication with input components or devices 104 and/or output components or devices 106. The processor 103 is operably connected to input 104 and/or output devices 106 capable of electronic communication with the processor 103, or, in other words, to devices capable of input and/or output in the form of an electrical signal. Embodiments of devices 102 may include the inputs 104, outputs 106 and the processor 103 within the same physical structure or in separate housings or structures.

The electronic device 102 may also include memory 108. The memory 108 may be a separate component from the processor 103, or it may be on-board memory 108 included in the same part as the processor 103. For example, microcontrollers often include a certain amount of on-board memory.

The processor 103 is also in electronic communication with a communication interface 110. The communication interface 110 may be used for communications with other devices 102, imaging devices 120, servers, etc. Thus, the communication interfaces 110 of the various devices 102 may be designed to communicate with each other to send signals or messages between the computing devices 102.

The computing device 102 may also include other communication ports 112. In addition, other components 114 may also be included in the electronic device 102.

Of course, those skilled in the art will appreciate the many kinds of different devices that may be used with embodiments herein. The computing device 102 may be a one-chip computer, such as a microcontroller, a one-board type of computer, such as a controller, a typical desktop computer, such as an IBM-PC compatible, a Personal Digital Assistant (PDA), a Unix-based workstation, etc. Accordingly, the block diagram of FIG. 1 is only meant to illustrate typical components of a computing device 102 and is not meant to limit the scope of embodiments disclosed herein.

The computing device 102 is in electronic communication with the imaging device 120. An imaging device 120 is a device that receives or transmits an imaging job, such as a Multi-Function Peripheral ("MFP") or computing device. Imaging devices include, but are not limited to, physical printers, multi-functional peripherals, a printer pool, a printer cluster, a fax machine, a plotter, a scanner, a copier, a logical device, a computer monitor, a file, an electronic whiteboard, a document server, etc. The imaging device may be a single or a plural grouping (e.g., pool or cluster) of two or more devices In light of the definition of an imaging device 120 above, the term imaging job, as used herein, is broadly defined as any instruction or set of instructions that are sent to an imaging device to cause an image to be printed, imaged, scanned, sent, etc., to or from the imaging device 120. Thus, the term imaging job includes, but is not limited to, a fax instruction or job to send a fax, a print job to print to a file, a print job to print to a particular window in a graphical user interface, a scan job to scan in an image from a scanner, a print job to print to a physical printer, a document manipulation job, a document conversion job, etc. Print jobs and printing devices are used to illustrate exemplary embodiments, but other kinds of imaging jobs and imaging devices may be used in implementations of the embodiments disclosed herein.

Figure 2:
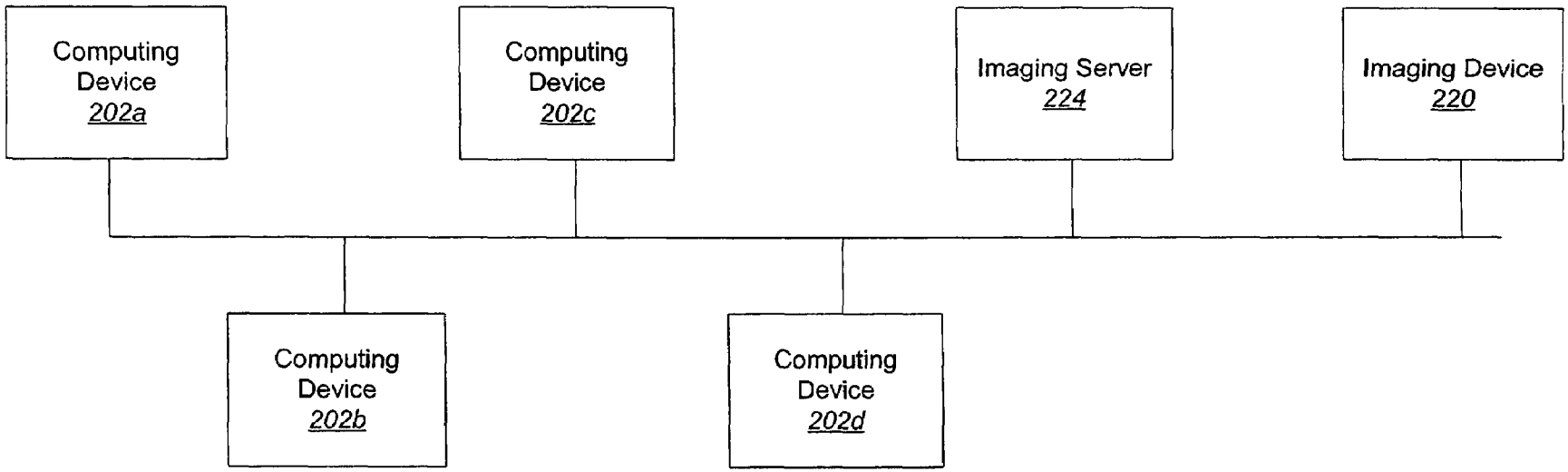
FIG. 2 is a network block diagram illustrating one possible environment in which the present systems and methods may be implemented.

FIG. 2 is a network block diagram illustrating one possible environment in which the present systems and methods may be implemented. The present systems and methods may also be implemented on a standalone computer system. FIG. 2 illustrates a computer network comprising a plurality of computing devices 202, an imaging device 220 and an imaging server 224.

This invention is independent of the job control command and image data language and syntax. For example, the job control language may be PJL and the imaging job data language may be PCL or Postscript.

Herein, reference to computing devices that construct and despool an imaging job to, or receive from, either an imaging device or server, will be referred to as imaging clients. Herein, reference to computing devices that manage an imaging device and receive imaging jobs and respool the imaging job to/from an imaging device, will be referred to as imaging servers.

References to computing devices that construct and despool an imaging job to either an imaging device or server, will be referred to as client computing devices (i.e., client). Herein, reference to computing devices that centrally manage a shared imaging device by receiving despooled imaging jobs from multiple client computing devices and re-despools the imaging job to the imaging device, will be referred to as server computing devices (i.e., server).

The embodiments disclosed operate independently of how the imaging job is initiated. For example, a print job may be initiated by an application using a printer driver which spools a print job to the print spooler. By way of further example, the print job may be initiated by direct printing using a utility that generates a print job ticket and despools the document data and job ticket directly to the printer.

The systems and methods herein are independent of the method to initiate the imaging job and the method to despool the image job and/or imaging result to/from the imaging client and imaging device. For example, an imaging job may be generated by a printer driver from an application. The application would convert the document into printing instructions, such as GDI (i.e., Graphics Device Interface) in the Microsoft family of operating systems. The printing instructions would then be passed to a printer driver installed on the client and/or server associated with the printing device. The printer driver would then convert the printing instructions into a printer dependent format, such as a raster image or PDL (i.e., Page Description Language). In other cases, such as Direct Printing, the document format can be directly interpreted by the printer and there is no preprocessing of the document format into a printer dependent format.

The embodiments disclosed also operate independently of the protocol used between the client computing and imaging device to obtain the job completion status. For example, the protocol may be a proprietary protocol over TCP/IP. Although Sharp's proprietary NJR (notify job return) protocol over TCP/IP will be used to illustrate the various embodiments, other protocols may also be used.

The systems and methods of embodiments of the present invention typically comprise one or more printing devices, which may be connected locally, through a network or through a remote printing environment. These systems and methods may further comprise a computing device capable of generating or transmitting a print job to a printing device or transmitting the location of a print job to a printing device as in "pull printing." These embodiments may also comprise a printer driver, a spooler, a print processor and other print system components that process, transmit or otherwise function to produce a print job. In some embodiments, these components may exist in a Microsoft Windows 98, Me, NT, 2000, XP, 2003 Server or similar operating system. Details of these operating system print system components and processes may be obtained by reference to the Microsoft Windows Driver Development Kits (DDKs) and associated documentation, which are hereby incorporated herein by reference.

Embodiments which utilize a Microsoft Windows® operating system generally comprise a printer driver, spooler, print processor, port monitor and other print system components which process print tasks generated through the operating system and applications running on the operating system. Embodiments used in conjunction with other operating systems will utilize print system components with similar functions, which may be referred to by the terms used in Microsoft systems.

Exemplary embodiments will be described with terminology related to a Microsoft Windows environment, however these terms shall relate to equivalent elements in other operating systems. For example, the print processor described in many embodiments will relate to a print processor common in the Windows environment as well as elements with equivalent functions in other operating systems.

The definitions in this and subsequent paragraphs apply throughout this specification and related claims. The term "print job" may refer to any combination of data that can be printed. A print job may comprise text, line art and/or graphics and may comprise part of a page, a single page or many pages. Print jobs may be rendered or un-rendered. Generally, a print job is generated by an application, such as a word processor, spread sheet, etc., however, a print job may also comprise a file or data in memory that may be sent directly to a print process.

The term "network" may refer to any combination of computing devices and peripherals, such as printing devices, wherein the devices can communicate with each other. The term "network" may comprise Local Area Networks (LANs), Wide Area Networks (WANs) and many other network types. A network may be connected using conventional conductive cable, fiber-optic cable, phone line cable, power line cable or other electrical and light conductors and other signal transmission media as well as wireless connections using infrared, RF or other wireless methods.

To simplify discussion of a printing system used under a Microsoft Windows® operating system, some groups of system components may be referred to collectively. Some components may also be referred to generically by their group name. For example, a spooler API server may be referred to as a spooler. A group of components comprising a spooler client interface, spooler API server, router, print job creation API and job scheduling API may be referred to as a spooler in a Windows NT/2000 operating system. A group of components comprising a language monitor, port monitor and port driver stack may be referred to as a port manager. A group of components comprising a file format director and EMF print processor DLL may be referred to as a print processor. Equivalent component groups may be referred to by these terms also whether in a Microsoft operating system or another system.

References to a Microsoft Windows or Windows operating system may refer to any version or variation of a Microsoft Windows operating system comprising Windows 95, Windows 98, Windows NT, Windows 2000, Windows ME, Windows XP, Windows 2003 Server and others. While exemplary embodiments may be directed to a Windows operating system and environment, systems and methods directed to other operating systems such as Macintosh, UNIX, DOS, Linux, MVS and others are to be contemplated within the scope of the present invention.

Embodiments may be embodied in software, firmware, hardware and other forms that achieve the function described herein. As embodiments may be adapted to many environments with varying computing devices, operating systems, printing devices, network hardware and software, applications and other variables, these embodiments may take many forms to achieve their function. Some embodiments may also be transmitted as signals, for example, and not by way of limitation, embodiments may be transmitted as analog or digital electrical signals or as light in a fiber-optic line. All of these embodiments are to be considered within the scope of the present invention.

In a typical printing environment, a user may initiate a print job, which generally comprises a single document generated by an application that is to be printed. In some embodiments of the present invention, a user may also initiate a print task, which may comprise one or more documents consisting of one or more pages each. A print task may also comprise multiple copies of a print job. A print job or task may be pre-processed into printer-ready data, such as output in a page description language (PDL) such as Printer Control Language (PCL), Adobe Postscript®, Adobe Portable Document Format® (PDF) and Tagged-Image File Format (TIFF) as non-limiting examples. A print job or task may also be journaled. In a journaled print job or task, rendering instructions are recorded for subsequent playback. Some examples of journaled formats are Enhanced Metafile (EMF) and Sharp's Printer Meta file (PMF).

Generally, when a print job or task is initiated, a user makes an input selection to initiate the process. The computing device may respond with the display of a dialog such as a print dialog box, a command line query, a panel display or some other form of user interface that allows a user to select print task options. One option may be the selection of the printing device such as a printer, plotter, Multi-Function Peripheral (MFP), CD burner or other device. Once the printing device is selected, a driver and, optionally, a print processor and other print system components may be loaded. Once the driver and/or other print system components are loaded, an additional dialog may be presented to prompt a user of options available on the selected device. Options such as print quality, paper size, orientation, tray selection, manual feed, stapling, watermarks, cluster printing, pool printing and other options may be selected.

In some embodiments of the present invention, print system components may present the user with a dialog that provides print job or print task interleaving options. Other embodiments may automatically select interleaving options for print jobs or tasks.

Once printing options have been selected or otherwise established, either manually or automatically, print job or task processing may commence. Print job or task processing may comprise construction of print job or print task specific information by the printer driver. This may comprise device initialization and environment data such as DEVMODE data in a Microsoft Windows environment. Rendering instructions are then compiled and either recorded for deferred playback (journaled data) or processed into printer-ready data. In some cases, a print task may be partially or wholly rendered into printer-ready data in a previous step and the compilation of rendering instruction may be skipped or partially skipped.

The output from a print driver, in a spooled print environment, may be referred to as a spool file and its contents may be referred to as spool data. A spool file may be recorded on disk, in memory, in cache or other storage media compatible with a computing device. In embodiments herein, a spool file may comprise interleaving data. Interleaving data may comprise printer output mode options such as, but not limited to, output tray options, output page orientation, output page location, media selection or other criteria affecting aspects of printing device output.

When the spool file is complete, control is passed from the driver to another print system component. In some systems, control is passed to a print processor, which may determine whether the data is in a printer-ready format and process the data accordingly. If the data is in a printer-ready format, it may be sent to the port of the selected printing device. If the data is journaled, it may be further processed into a printer-ready format. This process may be referred to as spooling as the data is spooled from the spool file to its destination. Once journaled data is processed into printer-ready data, it may be despooled to the port associated with its destination printing device.

The present systems and methods improve the method to provide on demand finishing of sub-portions of an imaging job, such as a print job. The present systems and methods also provide a means for on demand interleaving short imaging jobs within a long or continuously running imaging job.

Finishing options include, but are not limited to, stapling, hole punching, folding, booklets, front/back cover insertion, etc. Traditionally, finishing options or actions occur on a per RIP boundary. RIP stands for Raster Image Processed or Processor. A RIP is a process that takes imaging data (e.g., PDL) and converts it into a bitmap for printing. Typically, to send a stream of sheets to be printed, where subsets of the sheets are to be separately stapled, each staple sequence has to be sent as a separate RIP. There are several reasons for this. First, most printing devices will not start processing a print job until they have received all the data associated with the print job. The common method is to encapsulate the print job with a start and end RIP sequence. The following are examples of a start and end RIP sequence.

```
Start RIP
    <Esc>%-12345X      # Universal Exit Language
    @PJL RESET         # Indicator that subsequent commands are PJL
                       # and issues a printer reset
End RIP
    <Esc>%-12345X      # Universal Exit Language
    @PJL EOJ           # Indicates end of job
```

One problem is that the issuance of a printer reset causes the printer to return back to its default settings. Thus, any setup for an earlier sequence (e.g., job control commands) is lost and needs to be reset on the next RIP, even if they have not changed.

Another reason why finishing options typically occur on a per RIP boundary is because the finisher does not know about intra-document operations. Instead, it performs its finishing tasks, such as stapling, on what the collator outputs as a set. In a conventional printing device, the progress of sheets occurs as follows: (1) the spool data is parsed into document RIPs, (2) each document RIP is processed by the RIP into a sequence of page images, (3) the page images, per RIP, are developed and fused onto sheets, (4) the sheets are assembled into sets, one per copy, (5) each set is accumulated in the collator, and (6) the collator outputs sets to the finisher.

The above method can be limiting in the case of a continuous print job, where each document is a continuation of the previous document (i.e., the ending state of the previous document is the same as the starting state of the next document), for the following reasons: (1) extra generation time/effort, (2) extra network traffic, and (3) extra interpreter time. Regarding the extra generation time/effort, the starting state of each document, such as the job and page preamble, has to be replicated for each document. In the case of where the state changes, the generation method has to also accumulate the changes. Regarding the extra network traffic, the replicated job/page starting states per document result in additional imaging data sent over the network for each document. Extra interpreter time is required because the interpreter has to parse and evaluate the replaced job/page starting states, even though it would otherwise be identical to the ending state of the previous job.

One method to provide on demand post-collation operations, such as finishing, can be demonstrated by the startjob and exitserver operators in Postscript, level 2. Typically, when a Postscript interpreter is first invoked to process an imaging job, such as after a power cycle, the interpreter instantiates an initial virtual machine (VM) state, where the initial VM state is the default machine state (e.g., default machine settings). When the interpreter starts processing an imaging job, an instance of the initial VM state is instantiated. The job is then processed within this machine state instance, and any changes to the state, such as device settings, are not propagated back to the initial VM state. When a second job is started, again an instance of the initial VM state is instantiated, which does not inherit any changes that occurred in the first job.

The above Postscript behavior can be altered using the Postscript startjob operator. When the startjob operator is invoked, the Postscript interpreter causes any changes that occur in the machine state of the job to be propagated to the initial VM state as well. Therefore, when processing is completed in the imaging job, any changes to the machine state (e.g., device settings) are now reflected in the VM state as well (i.e., persist). Thus, if a subsequent imaging job is processed, the machine state that is instantiated will be this persistent machine state and not the initial VM state.

The above method could be used to perform some limited on demand finishing. In this method, one might create an on demand finishing job as follows: (1) create a Postscript ("PS") job using the startjob operator, (2) define macros for the job preamble, finishing operations and a page preamble, that are to be used across document boundaries, and (3) for each document, use the macro calls that now persist in the VM state for replicating the job and page preambles and to issue the finishing operations. This method provides several improvements including the following: (1) the job generation does not spend extra time replicating the job/page preambles, (2) if a startjob operator is used in each document, the job generation system does not need to accumulate state changes, (3) no extra traffic is generated, since the job/page preambles are not replicated, and (4) some interpreter time is saved in that the macro definitions do not need to be parsed per document. Using this method for creating on demand finishing jobs has some limitations. For example, macro invocations have to be re-evaluated, per replicated call. Job commands outside of PS do not persist and would have to be replicated (e.g., PJL). Another limitation is that jobs cannot be interleaved. If another job is interleaved, it will unintentionally inherit the persistent state of the other job and may result in undesirable effects. Since jobs cannot be interleaved, if the long continuous job is paused or idled for any period of time, the imaging device remains idle as well (i.e., can't be used for another print job). A dedicated connection is usually maintained to the device for continuous jobs.

Another limitation of using the method for creating on demand finishing jobs is that once a continuous job is terminated, the postscript 'exitserver' operator must be used to restore the VM state to the initial VM state. If it is not reset, subsequent unrelated jobs would inherit the persistent state and may result in undesirable effects. Any permanent persistent data from other jobs, such as font downloads, would be lost on the exitserver call, and have to be recreated.

The systems and methods herein enable intra-document post-collation operations, such as stapling and job interleaving, in long continuous print jobs.

An example of a continuous print job is an application that periodically generates invoices, where each invoice is printed on a standard template (e.g., downloaded form). An example of on demand finishing would be a requirement that if the number of invoice items per customer exceeds one printed sheet, then those sheets are stapled together.

As will be more fully explained below, in one embodiment this method introduces into the interpreter the ability to save and restore the accumulated job/page context (i.e., persistent data, such as duplex, font downloads, page orientation, etc.) and the ability to control the saving and restoring of a job/page context from the print generation source. The job/page context can be saved and restored across a printer reset. Using this method, a continuous print stream of pages can be partitioned at arbitrary points to implement intra-document finishing (e.g., stapling) and job interleaving (i.e., printing multiple jobs simultaneously), simply by having a process upstream inserting commands into the job stream to save context, terminate the RIP and start a new RIP and restore the context.

The process, which may be embodied in a firmware interpreter, can save and restore a context across a RIP boundary. Furthermore the upstream process, at an arbitrary point, can partition a job stream into RIPs and instruct the firmware to save/restore the job/page context across the RIP boundaries.

Generally, the present systems and methods include a computer based imaging system, such as print/copy/scan/fax, and document conversion/manipulation, comprised of one or more imaging clients, one or more imaging devices and optionally one or more imaging servers. One feature disclosed is that an imaging job interpreter may save/restore job/page persistent states (i.e., context) across raster image processing (RIP) boundaries. Another feature is that an upstream process may insert commands into an imaging job stream at arbitrary points to save context/terminate RIP and start RIP/restore context, whereby additional imaging data can be inserted to perform intra-document on demand operations such as finishing (e.g., stapling) and multi-job interleaving.

Figure 3:
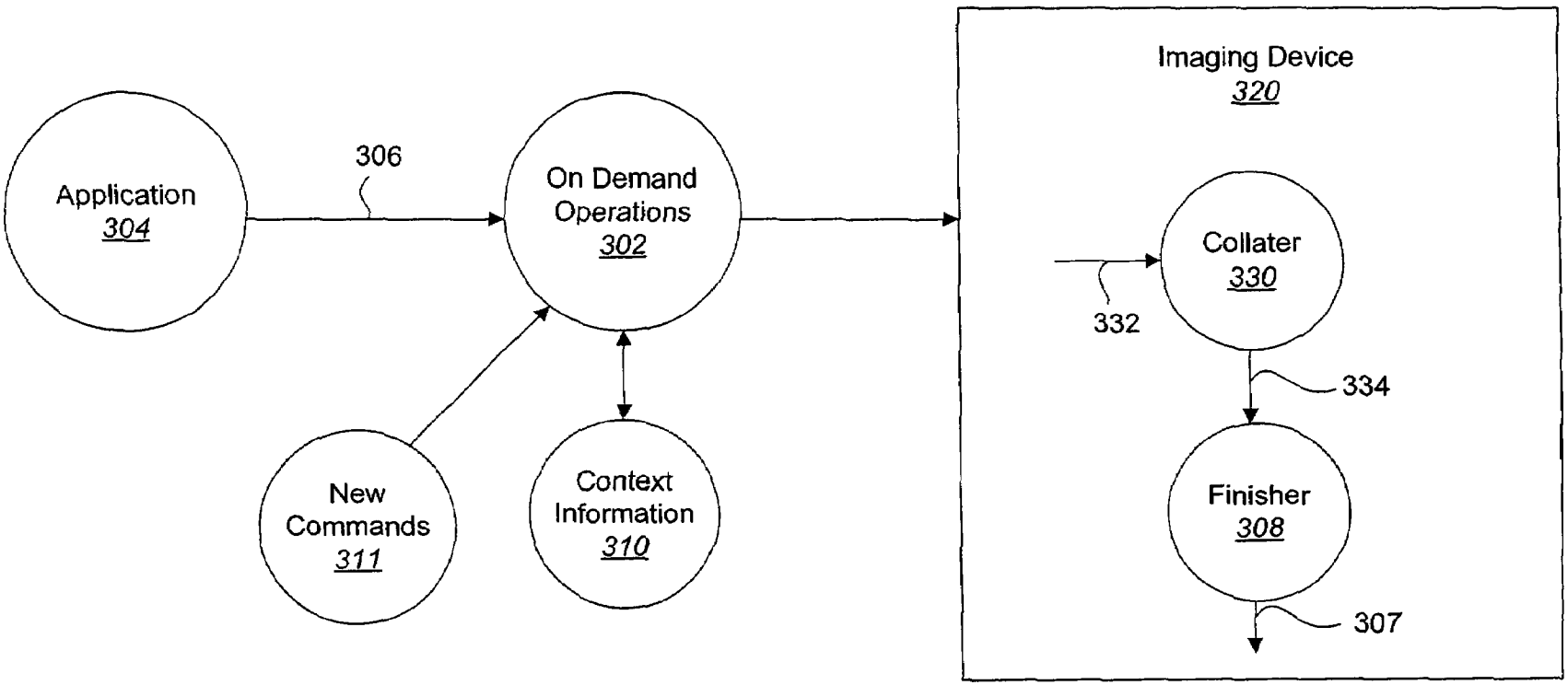
FIG. 3 is a logical block diagram to provide a context for the systems and methods herein.

FIG. 3 is a logical block diagram to provide a context for the systems and methods herein. The systems and methods described herein may be implemented on one or more computers or on one or more electronic devices. In addition, a computer network may be involved. Because of the different embodiments that are possible, the elements shown in FIG. 3 will be discussed generally. Following FIGS. 3 and 4, several embodiments will be illustrated and discussed.

An on demand operations process 302 or set of instructions is disposed in between the finished output 307 and the application 304 or program sending the imaging job 306. Thus, the on demand operations process 302 is upstream from the finisher 308 of the imaging device 320. In one embodiment the on demand operations process 302 is upstream from the imaging device's job interpreter/rasterization process. In this embodiment the on demand operations process 302 may be implemented inside the device's print controller.

With the on demand operations process 302 as shown, the originating application 304 or source 304 and the printing or imaging device 320 do not need to know of the on demand operations process 302. Both the application 304 and the imaging device 320 may be unaware of the on demand operations process 302.

Various embodiments of the on demand operations process 302 will be described and illustrated below. The on demand operations process 302 may be implemented in various ways, including embodiments where it is part of the operating system or where it is not part of the operating system. In addition, the process 302 may comprise more than one software or hardware component, or the functionality of the process 302 may be achieved by one or more pre-existing components that have been modified accordingly. The on demand operations process 302 may be implemented on a host computing device, the imaging device, an intermediate component interspersed between the host and device, or distributed across multiple devices and/or components.

The on demand operations process 302 may be used to add a post-collation operation to an imaging job, to interleave another imaging job, or other modifications that may take place after an imaging job has been generated. The process is downstream from the origin of the imaging job. The on demand operations process 302 may save and/or restore context information 310 from and/or to the imaging job. The process 302 may also insert new commands 311 into the imaging job, as will be more fully discussed below. For the embodiment where the on demand operations process 302 is being used to add a post-collation operation to an imaging job, the collator 330 and finisher 308 of the printer 320 are shown. Sheets 332 are fed into the collator 330. From the collator 330 sets 334 of the sheets 332 are input to the finisher 308 for finishing.

Figure 4:
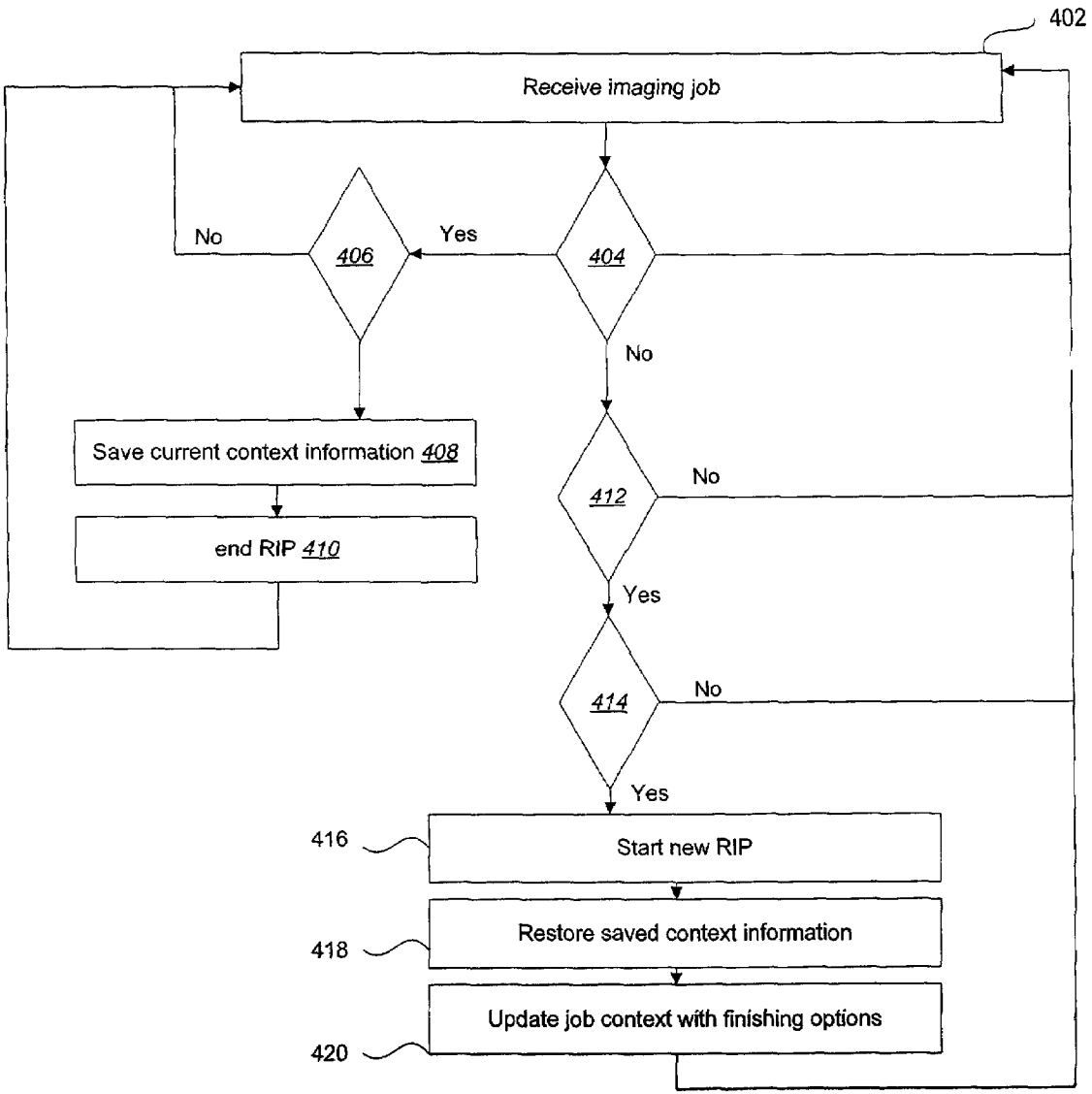
FIG. 4 is a flow diagram of one method of operation for an on demand operations process.

FIG. 4 is a flow diagram of one method of operation for an on demand operations process 302. Various other embodiments and features will be discussed further herein. The process receives 402 an imaging job. Receiving 402 an imaging job means at least some portion of the imaging job has been received, but not necessarily the entire imaging job. The process then parses the imaging job to locate 404 a page end boundary. If the process determines 404 that it has found a page end boundary, it then determines 406 if the page ends a sequence of pages where a finishing option or job interleave will be applied. If the page does end a sequence of pages where a finishing option or job interleave will be applied, the method then saves 408 the current context information and ends 410 the current RIP. If the page does not end a sequence of pages where a finishing option or job interleave will be applied, the process continues to receive 402 or parse the imaging job (if the imaging job has all been received, the process may simply be continuing to analyze the imaging job but not necessarily continue to receive it).

If the process determines 404 that it has not found a page end boundary, it then determines 412 if it has found a page begin boundary. If it determines 412 it has not found a page begin boundary, it returns to receiving 402 or parsing the imaging job. If it determines 412 it has found a page begin boundary, it then determines 414 if the page starts a sequence of pages where a finishing option or job interleave will be applied. If the page does start a sequence of pages where a finishing option or job interleave will be applied, the method then starts 416 a new RIP, restores 418 saved context information and updates 420 the job context with finishing options. The process then continues to receive 402 or parse the imaging job.

Figure 5:
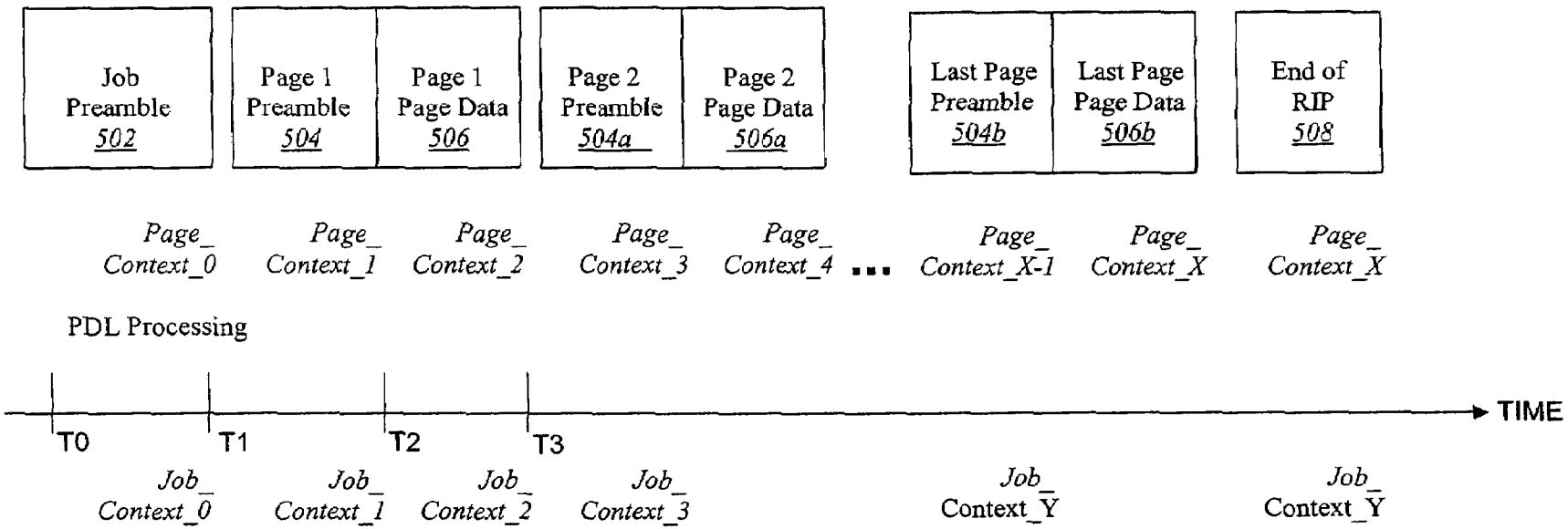
FIG. 5 is a diagram illustrating the progression of the job and page contexts.

FIG. 5 is a diagram illustrating the progression of the job and page contexts. In a conventional imaging job, such as a print job, the job and page context progresses as shown and described in relation to FIG. 5. On initiation of processing the imaging job, shown at time T0, the job context is set to the device default settings (Job_Context_0). The job preamble 502 (e.g., PJL header), is processed and the job context is set to the initial job context plus any changes specified in the job header (Job_Context_1), shown at time T1. At the end of the job preamble 502, a page context is created. The page context is set to the default page context plus any settings in the job context that are also a page context (Page_Context_0), illustrated at time T1.

The page preamble 504 for the first page is processed and the page context is set to the initial page context plus any changes specified in the page preamble (Page_Context_1) at time T2. At the end of the page preamble, the job context is updated for any settings in the page context that are also a job context (Job_Context_2).

The page data 506 for the first page is processed and the page context is updated for any page changes from the page data (Page_Context_2). As shown by FIG. 5, the page context (represented as Page_Context_<number>) continues to progress as pages are processed. Similarly, the job context (represented as Job_Context_<number>) continues to progress as well. Finally the end of the RIP 508 is encountered wherein the page context ends with Page_Context_X and the job context ends with Job_Context_Y.

Figure 6:
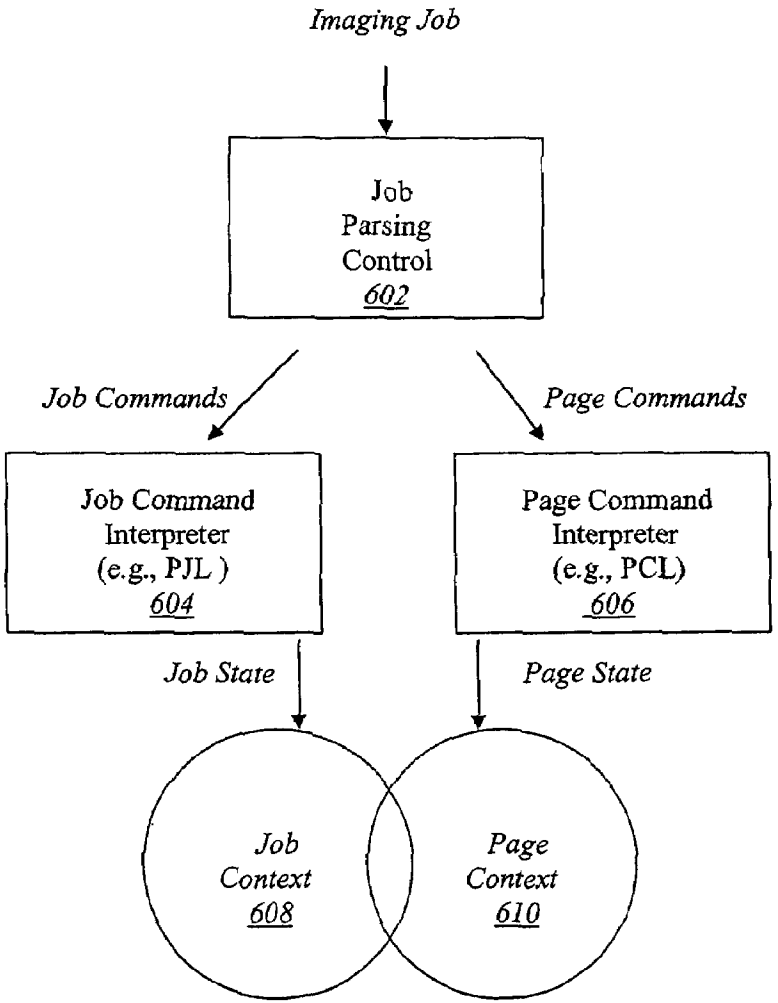
FIG. 6 is a diagram illustrating the maintenance of the job and page contexts.

Referring now to FIG. 6, maintaining the job and page contexts is illustrated. In this figure the job control commands 602 are processed by a job control command interpreter 604, such as a PJL interpreter in a print or fax job, and the page control and data commands by a page command interpreter 606, such as a PDL interpreter in a print or fax job. Each one maintains a context of the current job state 608 or page state 610. As can be seen in the illustration, the two contexts typically share some overlap.

Figure 7:
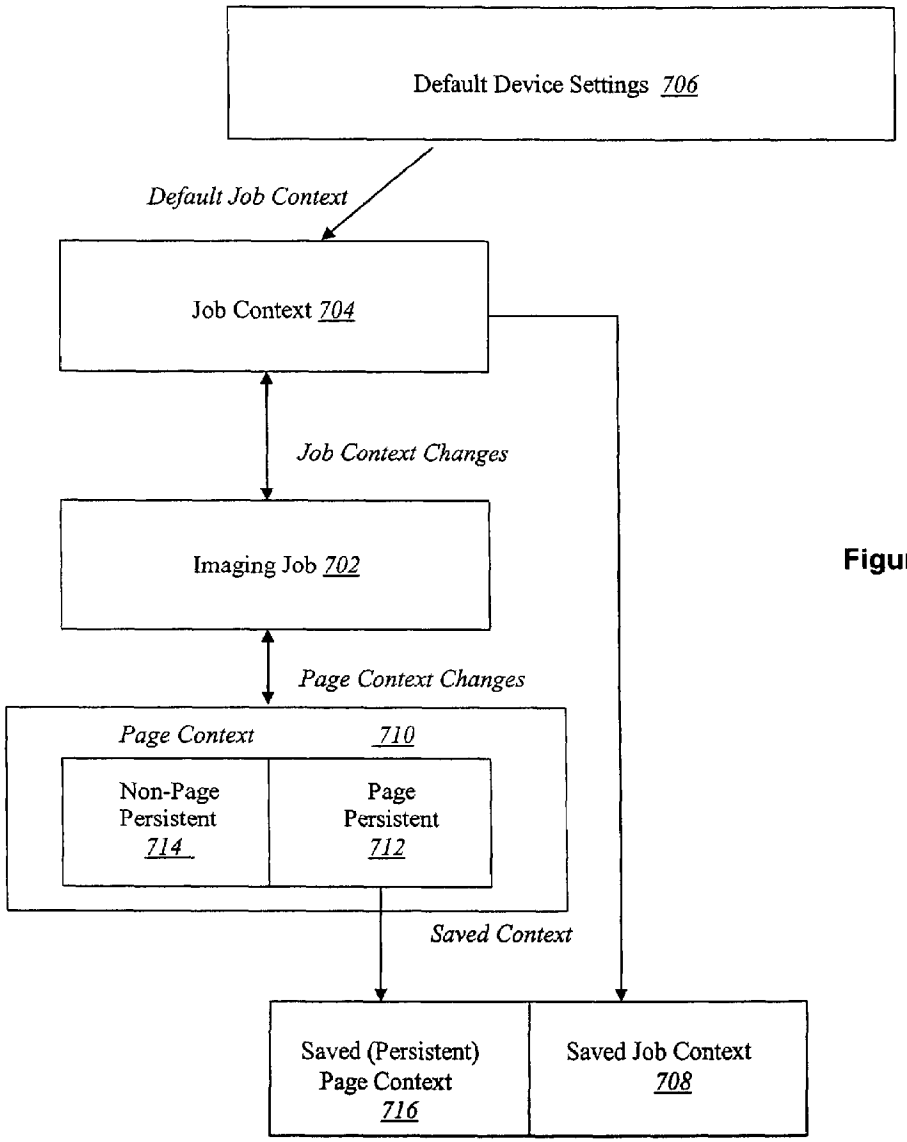
FIG. 7 is a flow diagram illustrating the saving of job/page context information.

FIG. 7 is a flow diagram illustrating the saving of job/page context information. In one embodiment, the firmware in the imaging device has the ability to organize the job and page context as some collection of data. As an imaging job 702 is processed by the imaging device 120 (not shown), the job and page context are maintained and updated.

Typically the job context 704 is initially set by the default device settings 706. As the imaging job is processed, the job context 704 is updated with any job context changes. The updated job context 704 is saved as a saved job context 708.

The page context 710 is further partitioned into persistent 712 and non-persistent 714 sections. The persistent section 712 includes those data items that continue to persist across page boundaries, until otherwise changed (e.g., page orientation in PCL5e). The non-persistent section 714 are those data items that do not persist across page boundaries (e.g., current cursor position in PCL5e). The updated page persistent data 712 is saved as a saved (persistent) page context 716.

The embodiment of FIG. 7 has the ability, when directed to do so, to save the job and page context. In one embodiment this is done on a page boundary. However the saving of the context information does not need to occur on a page boundary. Typically, the job context 708 and page context 716 would be saved as "copy on write". In this case, a copy of the job and page context 708, 716 would not be made until either the job/page context was modified or a new job/page context was created. Further, if a restore occurred before a modification or replacement occurs, in one embodiment a copy may not be made. In the embodiment shown in FIG. 7, where the save job/page context occurs on a page boundary, only the persistent section 712 of the page context 710 is saved, and not the non-persistent section 714.

The system may receive a command to save the job/page context from the imaging data. In one embodiment, the command appears as a command that immediately follows the end of a page boundary. The command may be of any syntactical form that could be recognized. In one example, the command is the same syntactical form as the page data (e.g., PDL). By way of further example, an imaging job, such as a print job, could issue a command to save the job/page context at either the end of the imaging job, or at some page in between.

Figure 8:
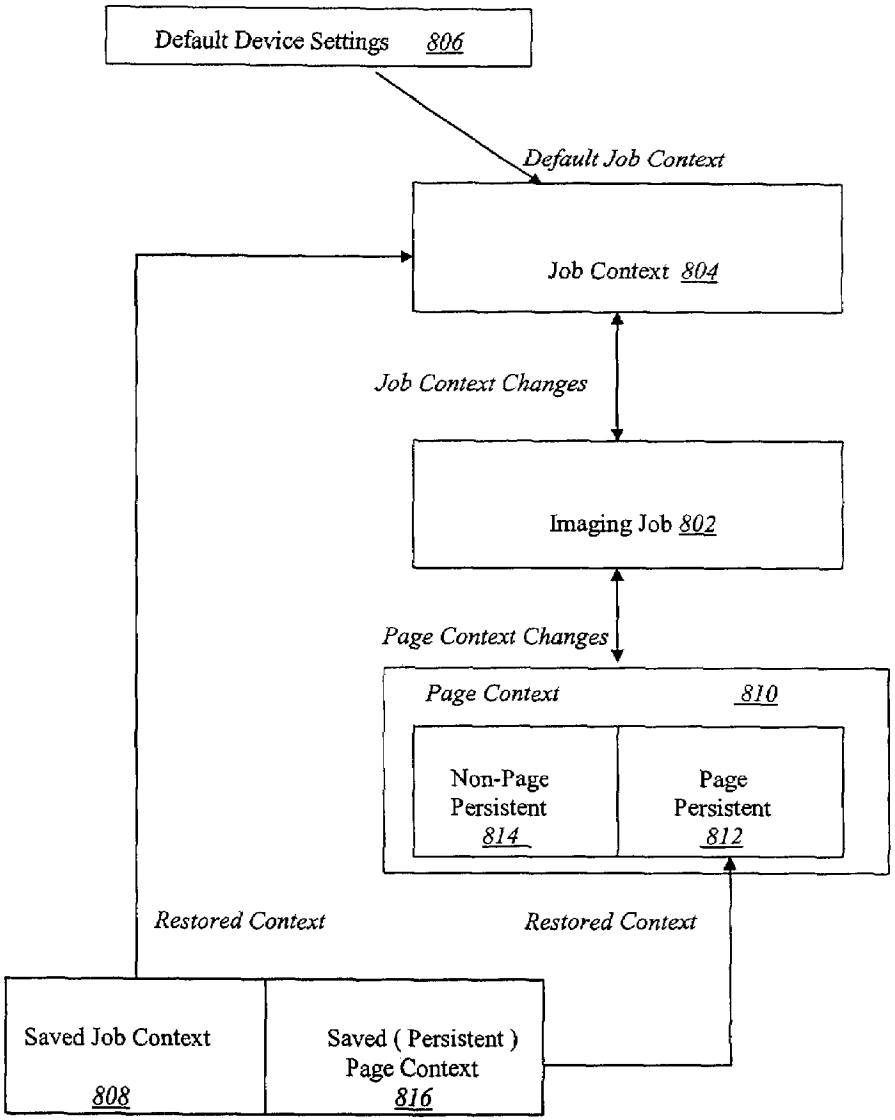
FIG. 8 is a flow diagram illustrating the restoring of job/page context information.

FIG. 8 is a flow diagram illustrating the restoring of job/page context information. In the embodiment of FIG. 8, the system has the ability, when directed to do so, to restore the job and page context. To restore the job context, the saved job context 808 is restored to the current job context 804. To restore the page context, the saved (persistent) page context 816 is restored to the current page persistent section 812 of the page context 810. When the job/page context is restored, the current job/page context, if any, is replaced, and becomes the current job/page context. Any subsequent commands that would alter either the job or page context are then applied to this new current context.

In this embodiment, the system can receive a command to restore the job/page context from the imaging data. In one embodiment the command appears as a command that immediately proceeds the start of an imaging job or page boundary. The command can be of any syntactical form that could be recognized. In one example, the command is the same syntactical form as the job (e.g., PJL) or page data (e.g., PDL).

Continuing with the above example, after the first imaging job 702 has saved the job/page context, processing starts on another imaging job 802 or subportion 802 of the same imaging job. In this example, the second imaging job 802, or subportion of the first imaging job, issues a command to restore the job/page context. The command causes the current job/page context 804, 812 to be replaced with the saved job/page context 808, 816, and the imaging job proceeds as if it was a continuation of the first imaging job.

Figures 9, 10:
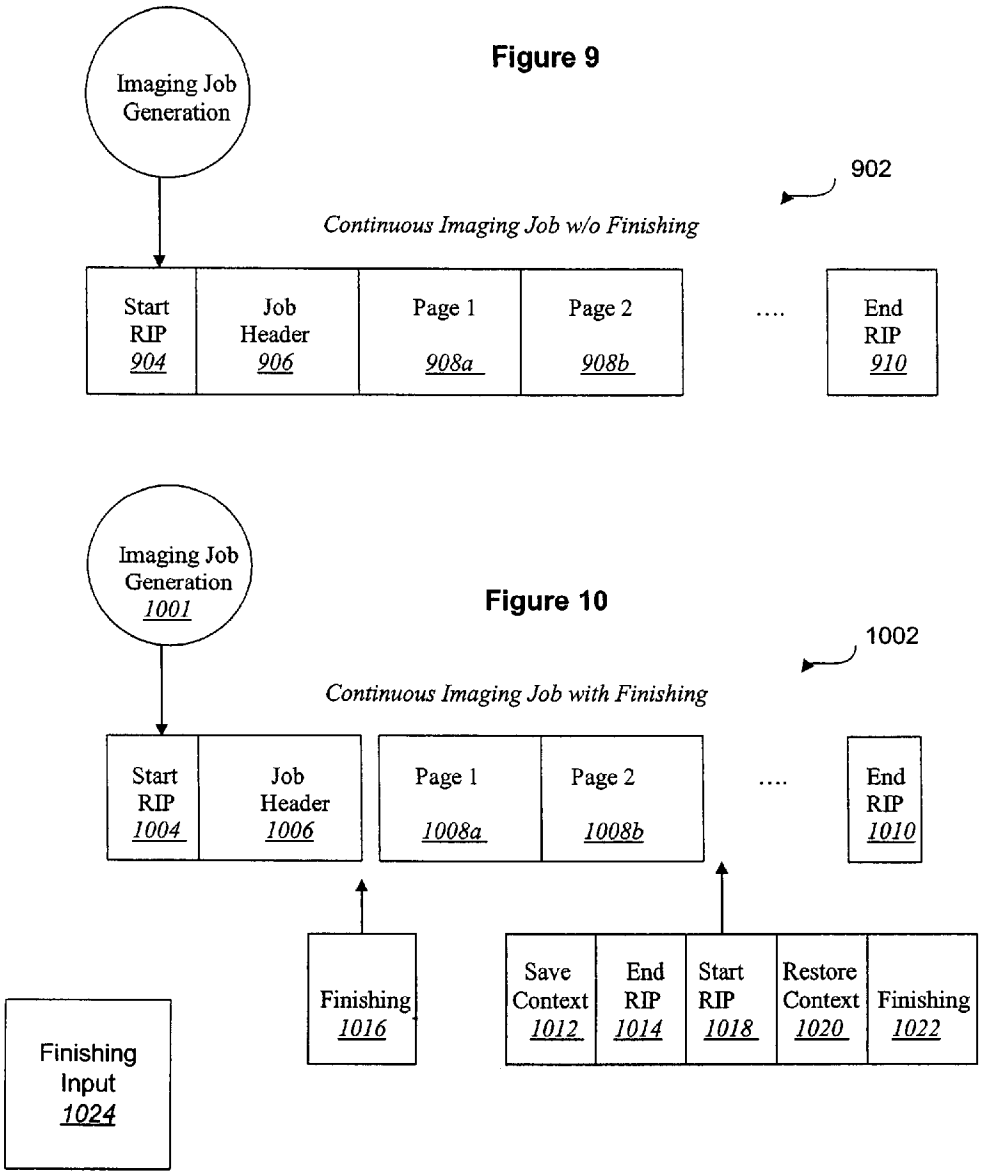
FIG. 9 is a block diagram illustrating an imaging job without finishing.
FIG. 10 is a block diagram illustrating an imaging job with finishing.

FIG. 9 is a block diagram illustrating an imaging job without finishing. In this embodiment, an imaging job 902 consists of a continuous running print job. The print job 902 consists of the following components: (1) a start RIP marker 904 (e.g., start document), (2) a job command header 906 (e.g., PJL header), (3) a sequence of pages 908 (e.g., PDL data, such as PCL or Postscript), and (4) an end RIP marker 910 (e.g., end document) when the continuous run ends. The imaging job 902 in FIG. 9 is an example of an imaging job before it has been processed by the on demand operations process 302 to add finishing options.

FIG. 10 is a block diagram illustrating the imaging job with finishing. In this embodiment, on demand finishing has been performed. First the imaging job was generated 1001. An application generates, or in conjunction with an imaging driver, creates the start RIP 1004 (e.g., start document) indicator to despool to the imaging device. Typically an application generates, or in conjunction with an imaging driver, creates the imaging job control command header 1006 (e.g., PJL). The imaging job also includes a continuous stream of imaging pages 1008.

In one embodiment, the system, at the end boundary of each page, makes a determination if the page ends a sequence of pages where a finishing option will be applied. If the page ends a sequence of pages where a finishing option will be applied it (1) saves 1012 the current job/page context and (2) ends 1014 the current RIP. It also (3) updates the job context 1006 for that sequence of pages with finishing options 1016.

In this embodiment, the system, at the begin boundary of each page, makes a determination if this page starts a sequence of pages where a finishing option will be applied. If this page starts a sequence of pages where a finishing option will be applied the system (1) starts 1018 a new RIP, (2) restores 1020 the job/page context, and (3) updates the job context with the finishing options 1022.

Thus, as shown through the examples of FIGS. 9 and 10, in one embodiment the imaging job has on demand (i.e., intra-document) finishing options. These finishing options were added after the imaging job was generated and could have been added anywhere in between imaging job generation and the final output from the finisher. Finishing input 1024 data is used by the system. The finishing input 1024 identifies what sequences of pages are to have finishing options and what finishing options are to be applied.

Figure 11:
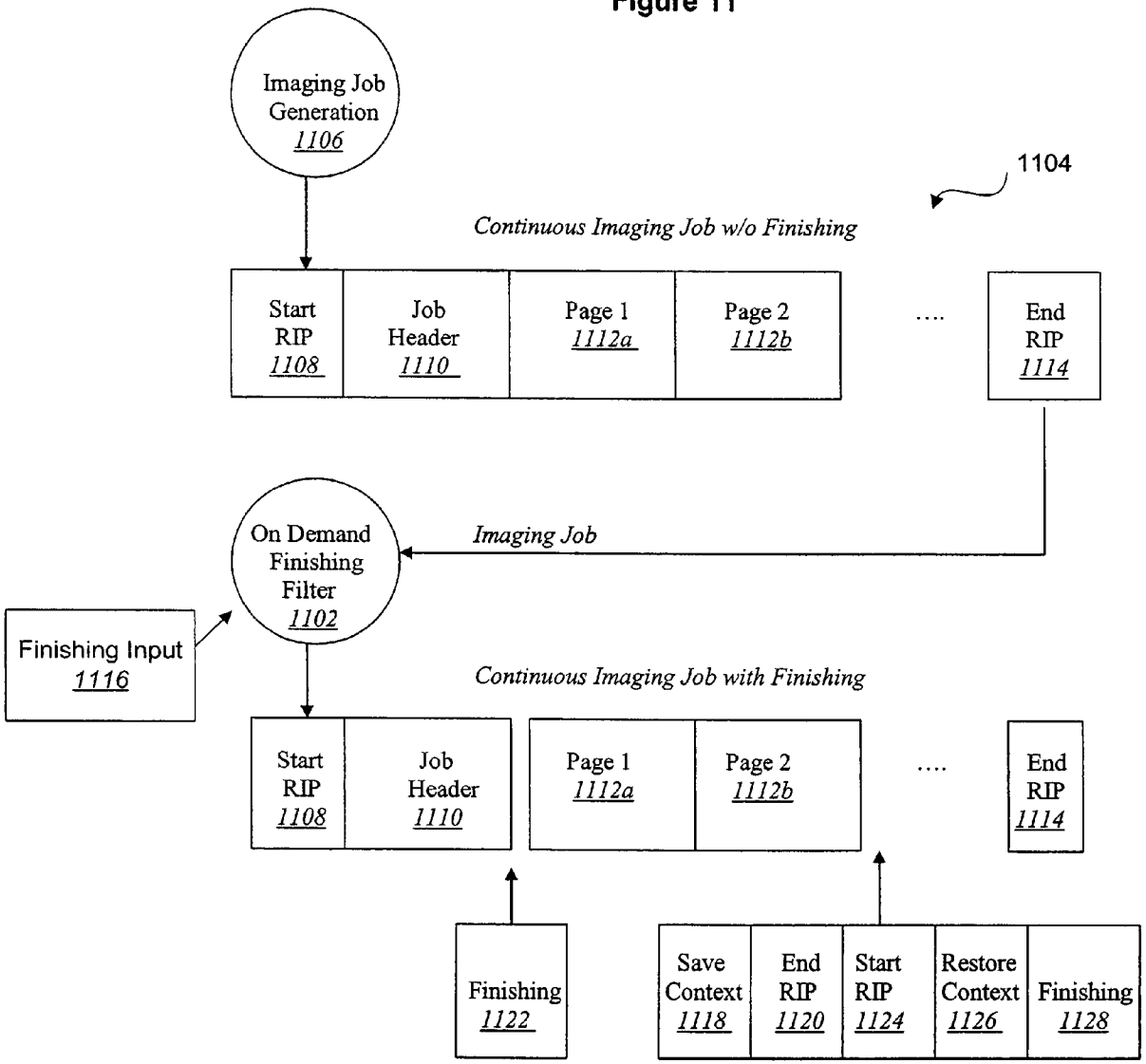
FIG. 11 is a block diagram illustrating the on demand finishing being applied by an on demand finishing filter.

FIG. 11 is a block diagram illustrating the on demand finishing being applied by an on demand finishing filter 1102. In this embodiment the on demand finishing options are added as a post-job generation process, such as by a job filter 1102. UNIX is an example of an operating system where job filters are used to control/modify/convert print jobs prior to despooling to the device. For example, psroff is a UNIX filter that converts ASCII text to postscript output. In this example a continuous imaging job 1104 is generated 1106 and includes the start RIP marker 1108, a job header 1110, the pages 1112 and an end RIP marker 1114.

In this embodiment the filter process 1102 does the following. First, it 1102 receives the generated imaging job downstream from the imaging job generation 1106 and upstream from the imaging device (not shown in FIG. 11). It 1102 parses the imaging job to identify page boundaries. The filter 1102 uses finishing input 1116 to determine which sequences of pages require on demand finishing. The finishing input 1116 may be input data, an algorithm, manual user input, etc. The finishing input 1116 provides a means whereby the sequences of pages that need on demand finishing are identified.

In one embodiment, the filter 1102, at the end boundary of each page, makes a determination, using the finishing input 1116, if the page ends a sequence of pages where a finishing option will be applied. If the page ends a sequence of pages where a finishing option will be applied it (1) saves 1118 the current job/page context and (2) ends 1120 the current RIP. It also (3) updates the job context 1110 for that sequence of pages with finishing options 1122.

At the begin boundary of each page, the filter 1102 makes a determination if this page starts a sequence of pages where a finishing option will be applied. If this page starts a sequence of pages where a finishing option will be applied it (1) starts 1124 a new RIP, (2) restores 1126 the job/page context, and (3) updates the job context with the finishing options 1128. Thus, the imaging job 1104 now has multiple RIPs and also has had finishing options added to certain sequences of pages.

Figure 12:
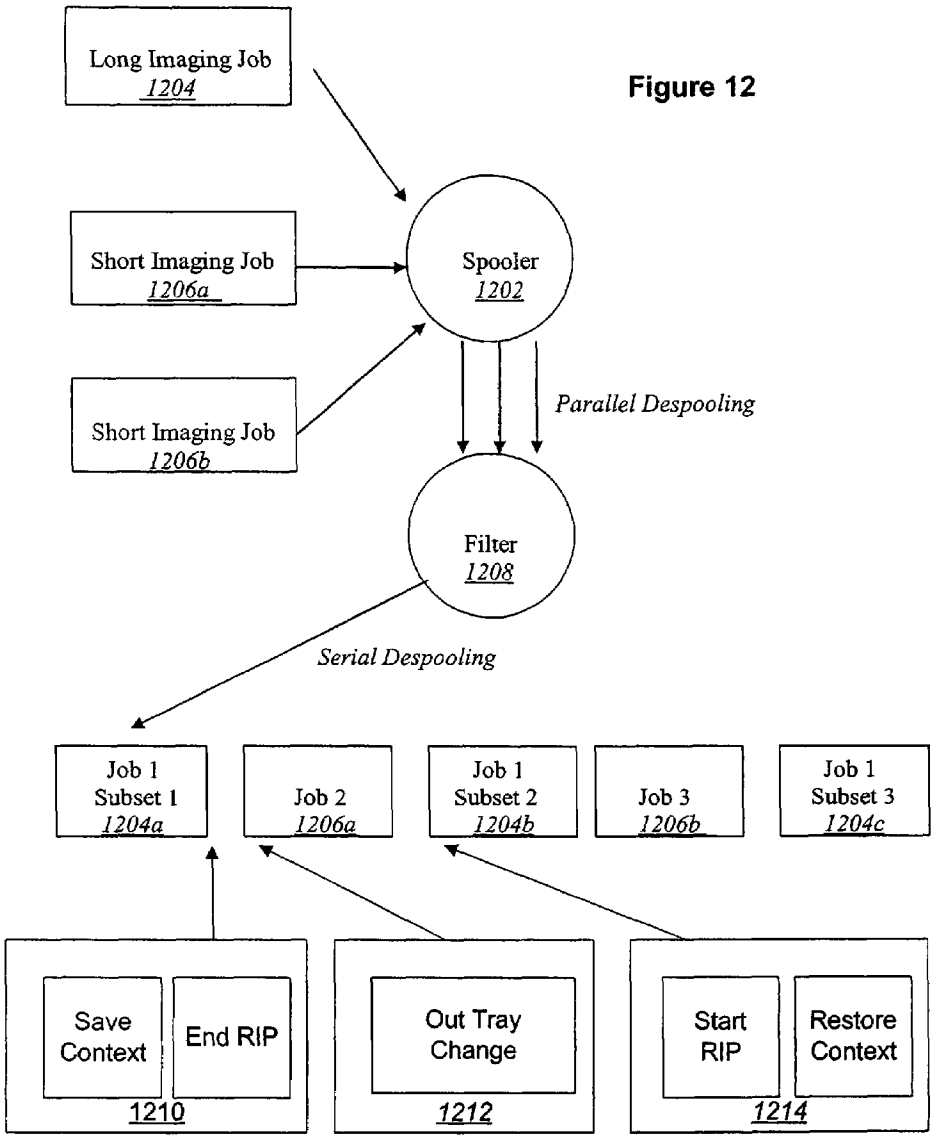
FIG. 12 is a block diagram illustrating on demand job interleaving.

Referring now to FIG. 12, the present systems and methods may also be used to implement imaging job interleaving. One example of job interleaving allows a spooler 1202 to de-spool multiple imaging jobs of the same type (e.g., print, fax, scan) to the same imaging device in parallel, that otherwise can only accept serial input of imaging tasks of the same type. In another example, job interleaving allows a spooler internal to the imaging device to de-spool multiple imaging jobs from an internal imaging queue to the same rendering/rasterization process in parallel.

Job interleaving is particular useful when an imaging device would be tied up by a long imaging job 1204, such as a continuous run print job. For example, a spooler 1202 may start the de-spooling of a continuous run print job 1204 to a printing device. During the de-spooling process and prior to termination of the continuous run, the spooler receives one or more short imaging jobs 1206 (e.g., non-continuous run).

In this embodiment, the spooler 1202 has the ability to decide to schedule despooling of multiple imaging jobs in parallel to the same device. Typically, the spooler 1202 would despool each imaging job using a separate spooler process thread. Each spooler thread would despool the imaging data through a job interleaving filter process 1208 that is upstream from the imaging device. The job interleaving filter 1208 may be incorporated into the spooler, or may be incorporated into another imaging subsystem component downstream from the spooler, such as a print processor, port manager, or imaging assist—which is any custom component added to the imaging subsystem between the spooler and port manager.

The job interleaving filter 1208 performs the process of interleaving the paralleled despooled jobs as a serial job stream to the imaging device. The interleaving is accomplished by inserting short imaging jobs 1206, or parts of, into the long imaging job 1204, such that they become part of the long imaging job, using the techniques disclosed herein. In general, when a short imaging job 1206, or portion of, is inserted into the long imaging job 1204, an embodiment of the filter process 1208 may perform the following actions, at the insertion point. It 1208 may locate a page boundary that separates a physical sheet. Then it saves 1210 the job/page context of the current RIP and terminates the current RIP. The process 1208 may then start a new RIP for the short imaging job and insert the short imaging job. In addition, it may modify 1212 the short imaging job output tray to output to a different tray than the long job tray. The filter process may then end the RIP of the short imaging job and start 1214 the RIP for the remainder of the long imaging job. The job/page context of the long imaging job is restored 1214 and it continues with the remainder of the long imaging job.

The example of FIG. 12 illustrates both of the short imaging jobs 1206 being interleaved within the long imaging job 1204. The long imaging job 1204 has been divided into multiple subsets of the imaging job 1204. The shorter imaging jobs 1206 have been interleaved between the subsets of the longer imaging job 1204.

In one method of this embodiment, the save/restore job/page context is implemented in the firmware using commands that are inserted at the page boundaries, as described and illustrated by the imaging job modification blocks 1210, 1212, 1214.

Various criteria may be used to determine the order of the interleaving of multiple jobs. For example, the criteria may include, but are not limited to, job priorities, size, job type, etc.

Figure 13:
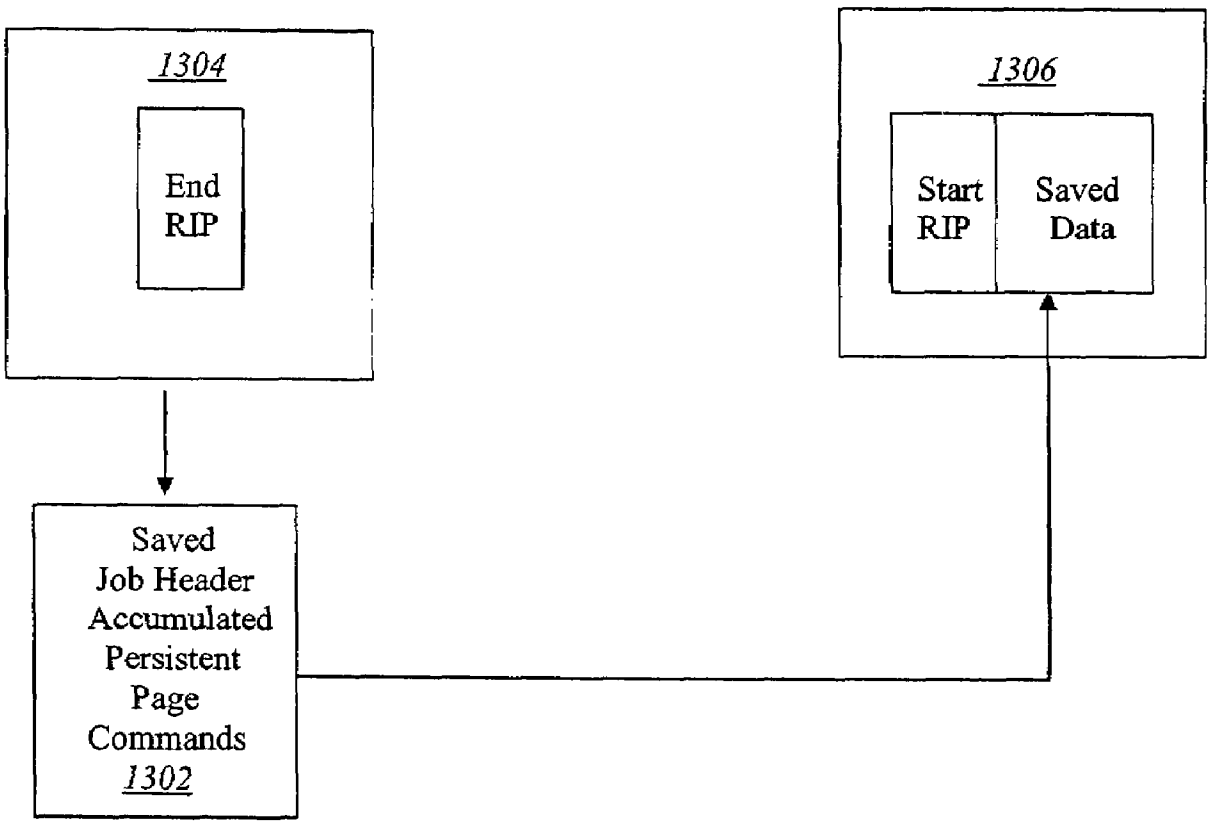
FIG. 13 is a block diagram illustrating the save/restore job/page context capability implemented by a filter process.

Referring now to FIG. 13, in an alternate method of this embodiment the system (which may be embodied in firmware in one embodiment) does not have the save/restore job/page context capability. In this case, this capability is emulated upstream from the imaging device, such as by the filter process.

One example of emulating this capability is to analyze the imaging data up to each insertion point. One such insertion point may be at an end RIP 1304. The analysis includes identifying and maintaining a copy 1302 of those instructions that will reproduce the current job/page state. This copy is the "saved job/page context" 1302. This case further differs from above, in that at each location that a restore job/page context 1306 occurs, the saved job/page context instructions are inserted in.

The following description and related Figures relate to systems and methods for identifying document or page boundaries. These systems and methods may be useful for use by the on demand operations being performed and discussed above.

Currently, the printing of vast amounts of document data that is compartmentalized (e.g., by store, by customer) for commercial purposes is largely done on large legacy computing systems, such as the AS/400 and OS/390 mini and mainframe environments. For example, a large enterprise may periodically print invoices for all its customers, or sales/stocking reports for all of its stores. In these cases, the document data is generally written on a prefabricated template form, which may be computer generated or pre-printed, for each account or store. Thus, each document consists of fixed data (i.e., form) and variable data (e.g., data specific to the account or store).

Typically, an application running on the legacy system is used to print documents in a single continuous run. Consider the following example. The application initiates a print job to the printer. The application creates a print job header that specifies the job wide settings (e.g., paper size). Then, either the application retrieves or generates the prefabricated form to be used for each document, or the operator loads the pre-printed forms into the printing device. The application, when not pre-printed, adds to the print job a download of the form. For each document (e.g., account/store), the application (a) retrieves the information specific to the account or store (e.g., database), and (b) formats the data according to the form and enters the formatted data into the print job. When the last document is created, the application adds to the end of the print job a print job footer.

One of the problems with this method is that some documents (e.g., account/stores) may only be a single sheet long (e.g., small account) while others may require multiple sheets (e.g., large account). In these situations, there is a desire to separate and group the multiple sheet documents together. Traditionally, this is done as a manual task by human inspection, and when a document has multiple sheets, the document is then stapled. One method to resolve this problem is to update the print job to partition each document as a separate job, and where each document has its own finishing (e.g., stapling). In this case, each document would be automatically grouped and separated from the other documents without human labor or error. The on demand operations systems and methods above may be used to provide the finishing.

One of the current problems in the industry is that many large companies that generate these continuous print jobs do not currently employ a method to automatically separate and finish each document. Each of these companies desires a way to retrofit this method into their legacy application/system. One such way is to update the application that generates the continuous print job to group and finish each document (e.g., account or store). For example, the application may be modified to do the following: (1) the application retrieves or generates the prefabricated form to be used for each document, or the operator loads the pre-printed forms into the printing device, (2) for each document (e.g., account/store), the application does the following: (a) the application initiates a print job to the printer, (b) the application creates a print job header that specifies the job wide settings (e.g., paper size) for the document, including finishing options (e.g., stapling), (c) the application, when not pre-printed, adds to the print job a download of the form, (d) retrieves the information specific to the account or store (e.g., database), (e) formats the data according to the form and enters the formatted data into the print job, and (f) adds to the end of the print job the print job footer.

The systems below provide a specific method for programming a filter process to recognize the document boundaries in a continuous print job, whereby the filter process will separate each document into its own print job with its own finishing options (e.g., stapling). An example of a continuous print job is an application that generates invoices, where each invoice is printed on a standard template (e.g., downloaded form). An example of on demand finishing would be a requirement that if the number of invoice items per customer exceeds one printed sheet, then those sheets are stapled together.

This system may be implemented as a process downstream from the generation of the print job (e.g., printer driver), and before the printing device. The downstream process performs the task of partitioning the print job, per document, into individual print jobs and adds the associated finishing options (e.g., stapling).

This system may use a computer learning method to recognize the locations of the document boundaries, such that the partitioning/finishing of the print job can be applied to any arbitrary continuous print job. This method may also use a print preview mechanism, such as a low resolution RIP, in the filter process to generate a visual display of the print job output. The user then trains the process to recognize the document boundaries by identifying some sampling of document boundaries, such as by using a cursor and mouse clicking on the page image.

There are two embodiments discussed below for implementing this method. In one embodiment, the document boundary detection process is used manually by the operator to partition the entire continuous print job. In this embodiment, the process would generate a print preview for the entire job. The user would then scroll through the print job and identify each document boundary (i.e., first sheet in document). The document boundary information would then be passed back to the filter process, which would use the information to partition the print job, per document, and add finishing. In a second embodiment, the document boundary detection is a computer learning process. In this embodiment, the process would generate a print preview for a sample of a representative print job. The user would then scroll through the sample print job and identify each document boundary (i.e., first sheet in document). The process would use difference information between each identified document boundary page (i.e., first sheet in document) and the non-document boundary pages (i.e., remaining pages in document) to develop a set of printing command sequences that uniquely identify the start of a document. This learned information is then used by the filter process on subsequent continuous print jobs of the same generation process to automatically partition, per document, and add finishing.

Figure 14:
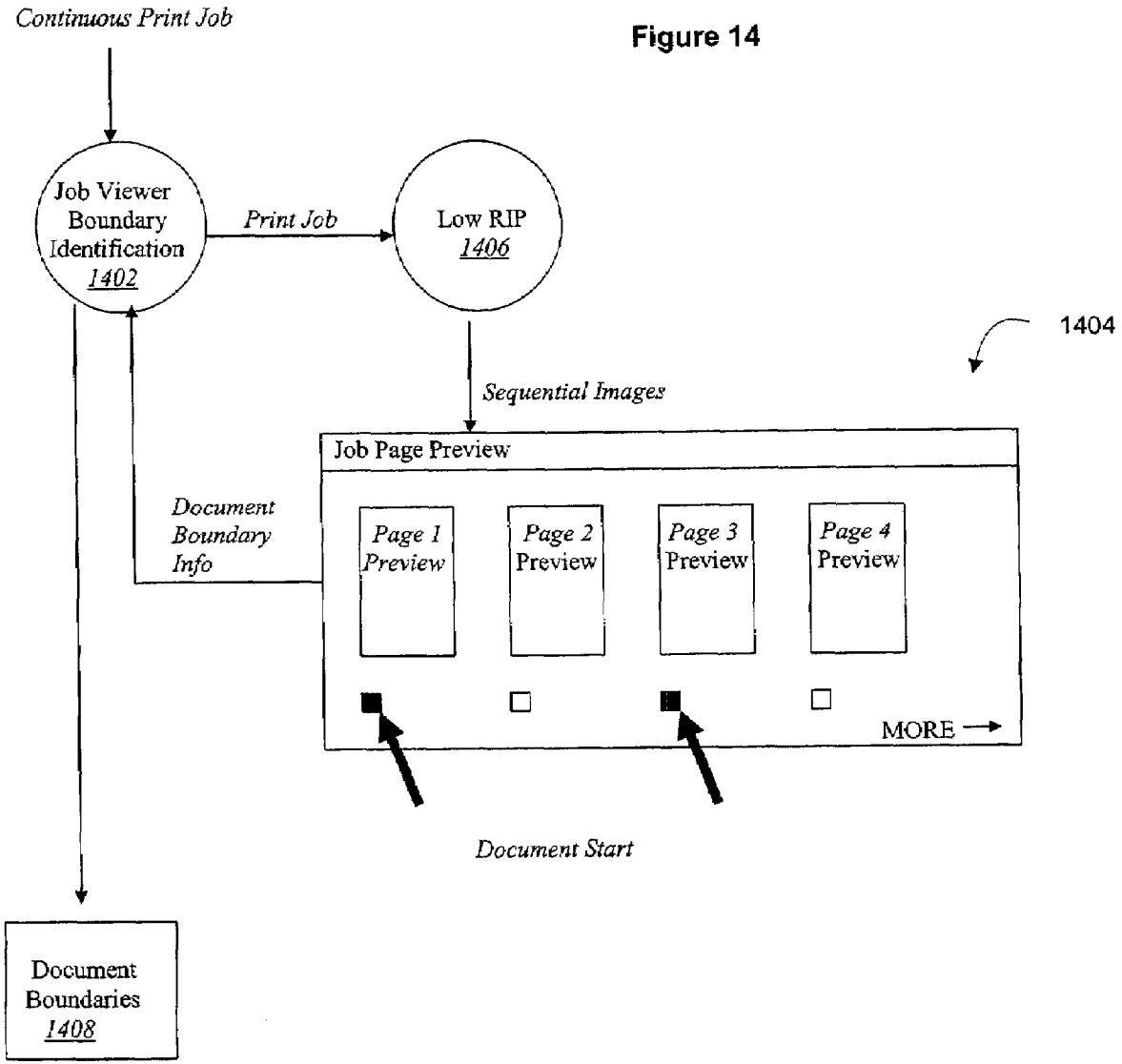
FIG. 14 is a block diagram illustrating an embodiment of a job viewer/boundary identification component.

FIG. 14 is a block diagram illustrating an embodiment of a job viewer/boundary identification component 1402. The continuous imaging job (e.g., print job) is further processed downstream from where the imaging job was generated (e.g., application report generator/printer driver). This downstream process, herein referred to as job viewer/boundary identification process 1402, performs several functions as will be described hereafter.

This process 1402 generates an imaging job preview 1404 (e.g., print preview) of the continuous print job, or sample of the print preview. The job viewer 1402 generates the imaging preview 1404 by processing the imaging data into a visual representation of the imaging data, such as using a low resolution (e.g., thumbnail) or full resolution RIP (i.e., raster image processing) before the imaging data is to be printed (e.g., print/fax/copy). In the embodiment of FIG. 14, the print job is previewed by processing the data through a low RIP process 1406.

The user then scrolls through the job viewer preview 1404 and visually identifies which images (i.e., printed page) represent a document boundary. For example, each image may have a checkbox associated with it. When an image is the start of a document, herein referred to as a document boundary, the checkbox is checked. The identified document boundary information is then fed back to the job viewer/boundary identification process 1402. The job viewer/boundary identification process 1402 further processes this information, to be discussed later, and stores information 1408 relating to the document boundaries in a manner that is accessible by other processes.

Figure 15:
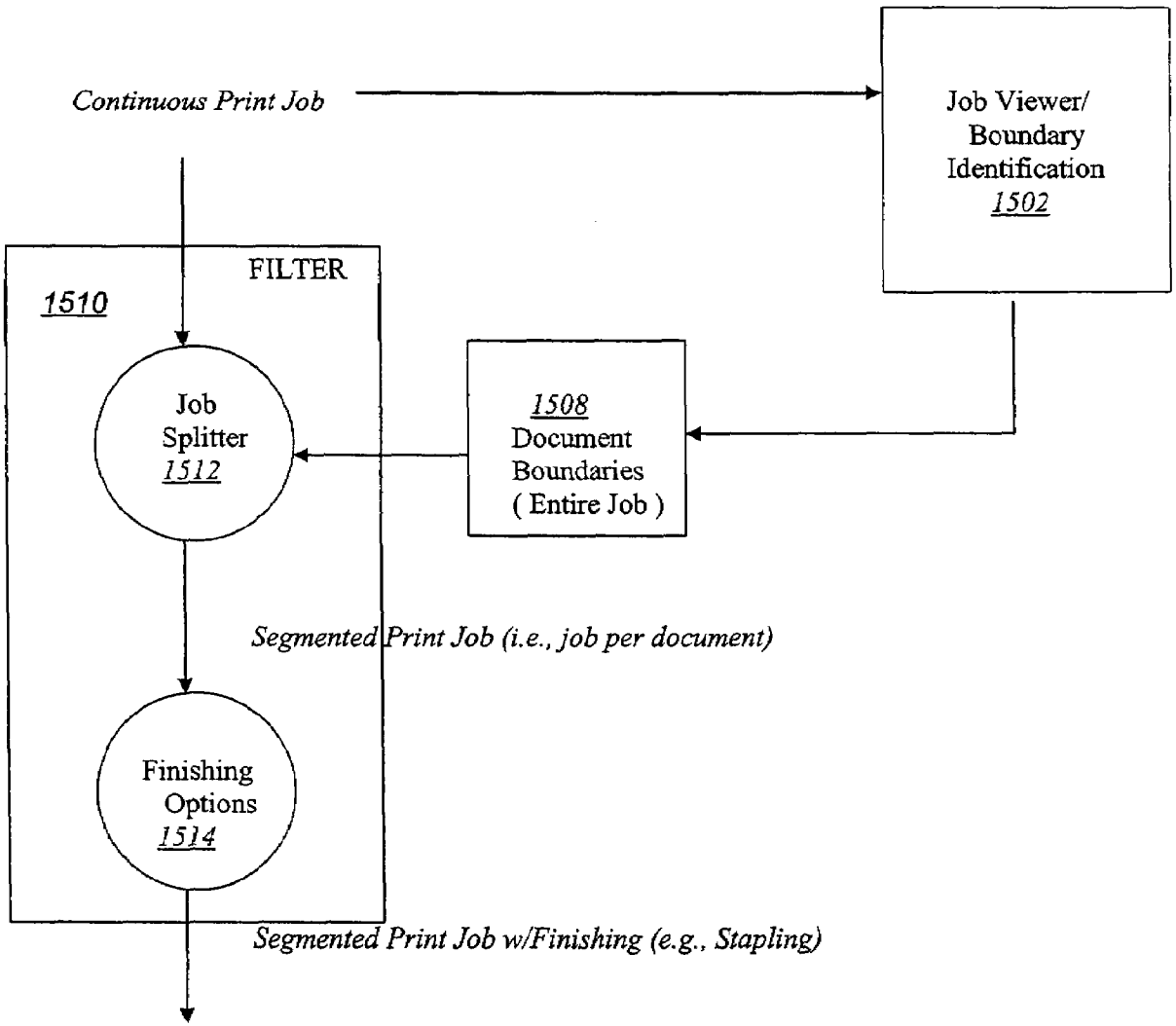
FIG. 15 is a block diagram illustrating the document boundaries being input to a job filter for use in adding job finishing to an imaging job.

FIG. 15 is a block diagram illustrating the document boundaries being input to a job filter for use in adding job finishing to an imaging job. In one possible embodiment, the entire imaging job is manually partitioned into documents using the job viewer/boundary identification process 1502. The job viewer 1502 then feeds the document boundary information 1508 back to the boundary identification process 1502 that stores all the document boundaries for this job in a manner that is accessible by a job filter.

As the document boundary information is generated, the imaging job is processed by the filter 1510 in parallel. The imaging job filter 1510 contains a job splitter process 1512 and a finishing options process 1514. The job splitter process 1512 uses the document boundary information 1508 from the boundary identification process 1502 to split the imaging job into individual jobs, one per document. The job splitter 1512 may also need to accumulate the job context state for persistent data. Persistent data is defined as any imaging command that persists across image boundaries. The individual imaging job is then created as follows:

Job Header
Persistent Data current in Imaging Job
Document Data from Imaging Job
Job Footer Finally, the individual imaging jobs are then fed into the finishing options process 1514. This process 1514 further modifies the individual imaging jobs to add finishing options, as described above. The choice of finishing options can be programmed into this process 1514 by any means, such as, but not limited to: preprogrammed entry, manual user entry, etc. For example, in a print job, the finishing options process may be programmed to staple each document, if it contains more than one sheet.

Figure 16:
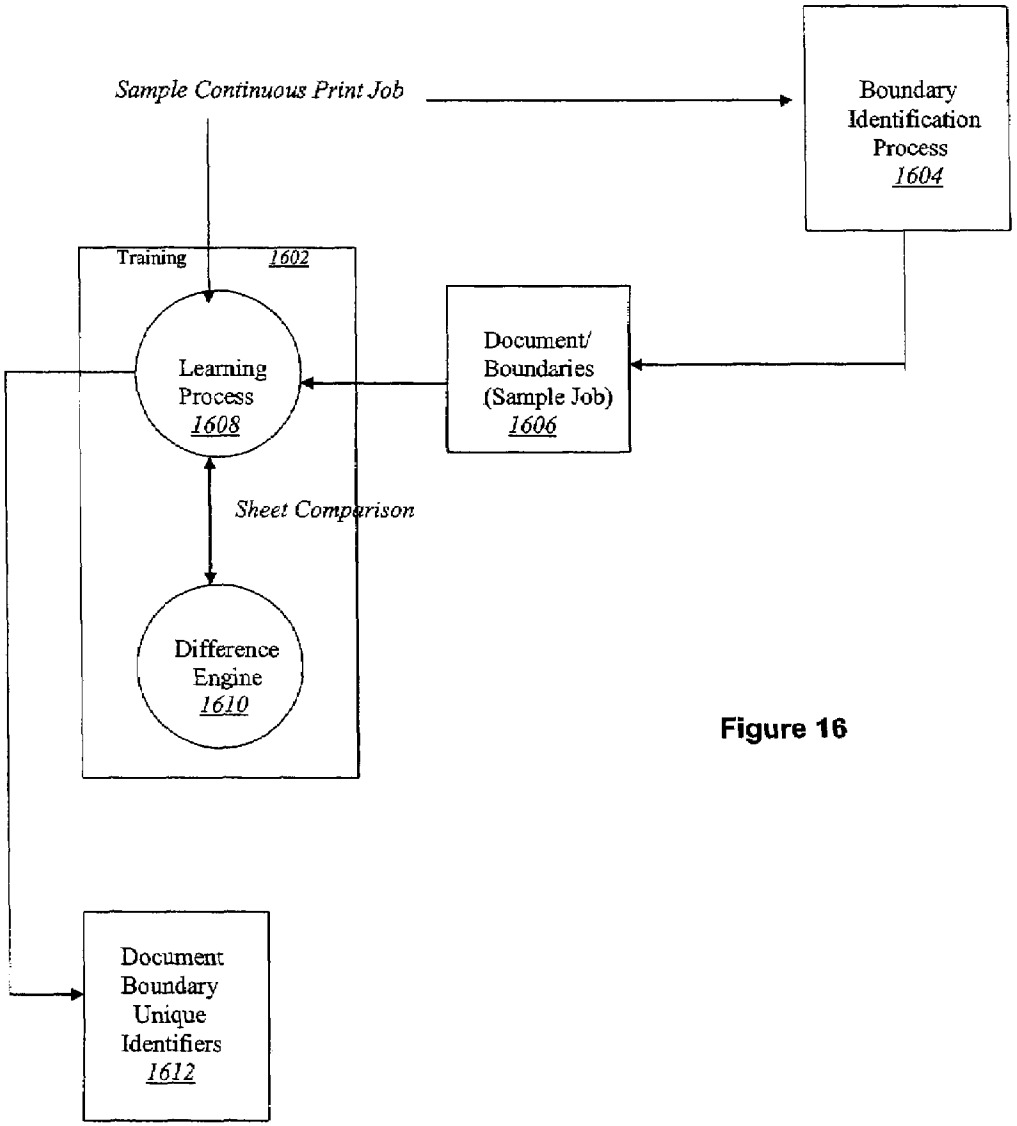
FIG. 16 is a block diagram illustrating a training component whereby the system may learn how to identify the document boundaries.

FIG. 16 is a block diagram illustrating a training component 1602 whereby the system may learn how to identify the document boundaries. In this embodiment the imaging job, or some subset of the imaging job, is analyzed by the job viewer/boundary identification process 1604. The job viewer, as described above, presents a preview of the imaging job. The user then scrolls through the job viewer and visually identifies which images (i.e., printed page) represent a document boundary. The identified document boundary information 1606 is input to a training process 1602.

The imaging job, or a subset of the imaging job, is also input to the training process 1602. Thus, the imaging job may be fed in parallel to the training process 1602 and the boundary identification process 1604. The learning process 1608 uses the document boundary information 1606 to learn how to identify the document boundaries automatically. For example, there may be a pattern that will uniquely identify each document boundary in the continuous imaging job.

The learning process 1608 can use any method to learn a pattern that distinguishes document boundary image from other images. For example, assume the continuous imaging job is an invoicing system, where the invoice data is written on a form. Further, if the invoice crosses a page, then the remaining pages of the invoice also use the identical form. In this example, recognition of the form does not help identify the boundary because every page uses the same form. Instead, assume that one field, the client's name, stays constant across an invoice. In this case, the learning process could use a difference engine 1610 to discover this field from some sampling of the continuous print job. Once the pattern is learned, the pattern 1612, that is the unique identifiers which help identify document boundaries 1612, is written out in a manner that is accessible by other processes.

Figure 17:
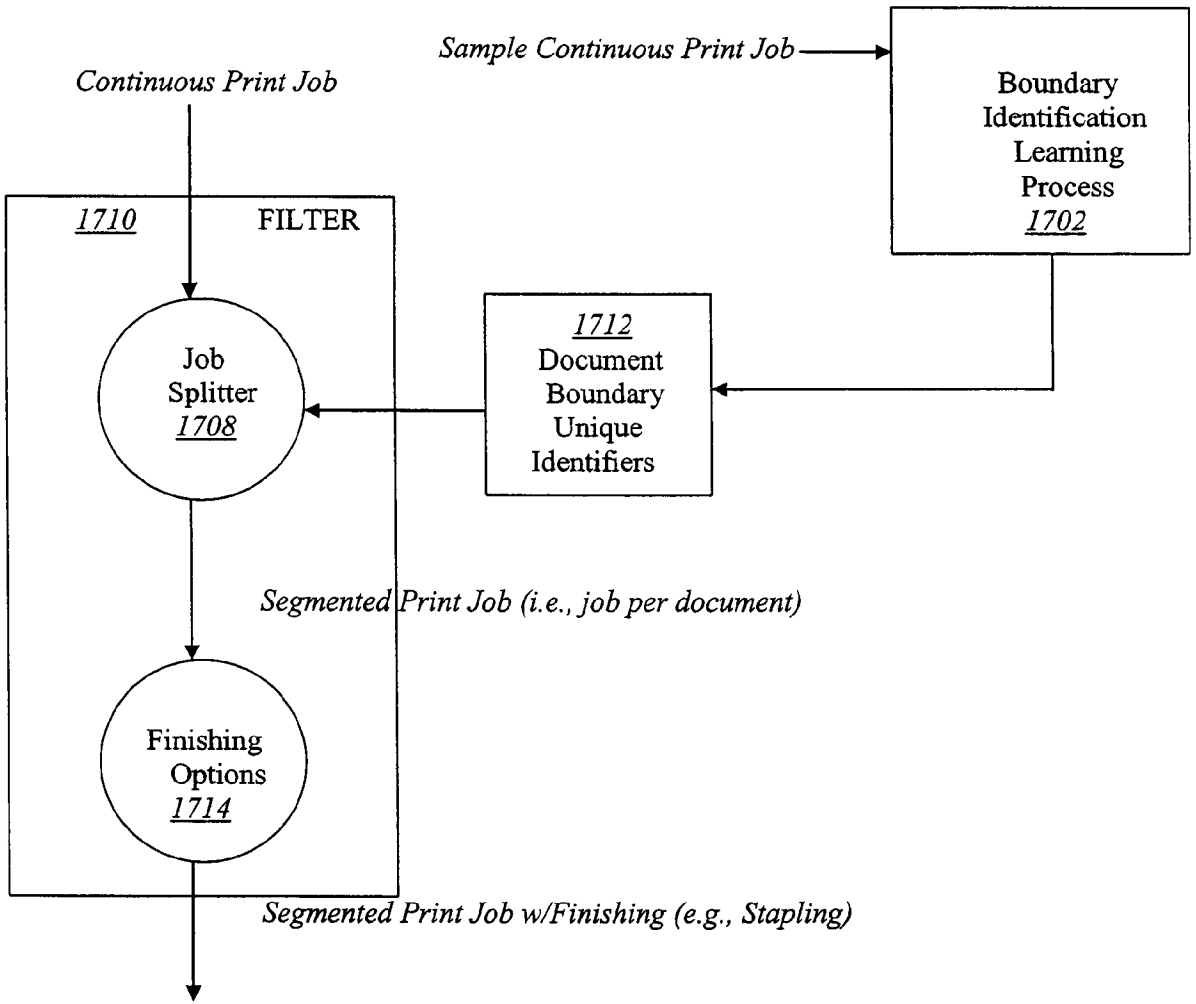
FIG. 17 is a block diagram illustrating the automatic partitioning of documents through the use of the document boundary unique identifiers.

FIG. 17 is a block diagram illustrating the automatic partitioning of documents through the use of the document boundary unique identifiers. This embodiment illustrates operation of the system after the training process 1702, or the boundary identification learning process 1702, is done training and has identified the document boundary unique identifiers 1712. Once the document boundary pattern 1712 is recognized and stored, subsequent imaging jobs of that use the same document boundary pattern can be passed through the job filter 1710.

The job filter 1710 is composed of two processes, the job splitter 1708 and finishing options process 1714. The job splitter 1708 examines each image in the continuous imaging job to determine if it matches the pattern (e.g., name changes in specific field, as in the case above). If so, the job splitter 1708 breaks this and the subsequent images into an individual imaging job, until the next document boundary. The construction of each individual imaging job is as described above. Each individual imaging job is passed to the finishing options process 1714. This process 1714 further modifies each individual imaging job according to the specified finishing, as described above.

Those skilled in the art will appreciate that the present systems and methods may be implemented in many different embodiments. Other embodiments include but are not limited to the spooling and despooling subsystems of the Apple MacIntosh operating system, the Linux operating system, System V Unix operating systems, BSD Unix operating systems, OSF Unix operating systems, Sun Solaris operating systems, HP/UX operating systems and IBM Mainframe MVS, AS/400 and OS/390 operating systems.

Although use with a printer was illustrated, it will be appreciated that the present systems and methods may be applied to other embodiments. For example, the present systems and methods may be applied to fax, scan and document operations.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array signal (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

The methods disclosed herein comprise one or more steps or actions for achieving the described method. The method steps and/or actions may be interchanged with one another without departing from the scope of the present invention. In other words, unless a specific order of steps or actions is required for proper operation of the embodiment, the order and/or use of specific steps and/or actions may be modified without departing from the scope of the present invention.

While specific embodiments and applications of the present invention have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention.

What is claimed is:

1. A method for adding a post-collation operation to an imaging job sent to an imaging device downstream from the origin of the imaging job, the method comprising:

receiving an imaging job downstream from an origination point of the imaging job and upstream from a job interpreter/rasterization process of an imaging device;

determining, at a page end boundary, if the page ends a sequence of pages where a finishing option will be applied, and if the page does end a sequence of pages where a finishing option will be applied, the method then saves current context information and ends a current RIP; and determining, at a page begin boundary, if the page starts a sequence of pages where a finishing option will be applied, and if the page does start a sequence of pages where a finishing option will be applied, the method starts a new RIP, restores saved context information and updates the job context with finishing options.

2. The method as in claim 1, further comprising parsing the imaging job to identify page boundaries.

3. A computer-readable medium for storing program data, wherein the program data comprises executable instructions for implementing a method in a computing device for adding a post-collation operation to an imaging job, the method comprising:

receiving an imaging job downstream from an origination point of the imaging job and upstream from a job interpreter/rasterization process of an imaging device;

determining, at a page end boundary, if the page ends a sequence of pages where a finishing option will be applied, and if the page does end a sequence of pages where a finishing option will be applied, the method then saves current context information and ends a current RIP; and determining, at a page begin boundary, if the page starts a sequence of pages where a finishing option will be applied, and if the page does start a sequence of pages where a finishing option will be applied, the method starts a new RIP, restores saved context information and updates the job context with finishing options.

* * * * *